US010203637B2

(12) United States Patent
Takagi et al.

(10) Patent No.: US 10,203,637 B2
(45) Date of Patent: Feb. 12, 2019

(54) FIXING APPARATUS HAVING A RESTRICTIVE GUIDE MEMBER

(71) Applicant: CANON KABUSHIKI KAISHA, Tokyo (JP)

(72) Inventors: Kenji Takagi, Odawara (JP); Hiroyuki Kadowaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/862,165

(22) Filed: Jan. 4, 2018

(65) Prior Publication Data

US 2018/0196378 A1 Jul. 12, 2018

(30) Foreign Application Priority Data

Jan. 11, 2017 (JP) ..... 2017-002376
Nov. 16, 2017 (JP) ..... 2017-220726

(51) Int. Cl.
*G03G 15/20* (2006.01)

(52) U.S. Cl.
CPC ..... *G03G 15/2028* (2013.01); *G03G 15/206* (2013.01); *G03G 15/2053* (2013.01); *G03G 2215/2035* (2013.01); *G03G 2215/2061* (2013.01)

(58) Field of Classification Search
CPC ..... G03G 15/2028; G03G 15/2053; G03G 2215/2016; G03G 2215/2029; G03G 2215/2035
USPC ..... 399/329
See application file for complete search history.

(56) References Cited

U.S. PATENT DOCUMENTS 8,731,450 B2 * 5/2014 Fujiwara et al. .. G03G 15/2053 399/329
8,948,671 B2 * 2/2015 Suzuki ..... G03G 15/2053 399/329

FOREIGN PATENT DOCUMENTS

JP 2005010201 A 1/2005
JP 2007033552 A 2/2007
JP 2016080989 A 5/2016

* cited by examiner

*Primary Examiner* — William J Royer
(74) *Attorney, Agent, or Firm* — Canon U.S.A., Inc. IP Division

(57) ABSTRACT

A fixing apparatus includes a guide member that guides a rotating member. The guide member has a contact surface that restricts a position of the guide member with respect to a stay by coming into contact with a surface of the stay on the upstream side in a printing-material conveying direction. The contact surface is disposed, in a direction perpendicular to the printing-material conveying direction, in such a manner that a center is downstream from ends in the printing-material conveying direction.

5 Claims, 21 Drawing Sheets

Comparative Example

Comparative Example

Comparative Example

Comparative Example

UPSTREAM END IN PRINTING-MATERIAL CONVEYING DIRECTION

CENTER ON UPSTREAM SIDE IN PRINTING-MATERIAL CONVEYING DIRECTION

DOWNSTREAM END IN PRINTING-MATERIAL CONVEYING DIRECTION

CENTER ON DOWNSTREAM SIDE IN PRINTING-MATERIAL CONVEYING DIRECTION

Comparative Example

Comparative Example

Comparative Example

Comparative Example

FIXING APPARATUS HAVING A RESTRICTIVE GUIDE MEMBER

BACKGROUND

Field of the Disclosure

The present disclosure relates to fixing apparatuses mounted to image forming apparatuses such as electrophotographic copying machines and electrophotographic printers.

Description of the Related Art

Film heating type apparatuses are known as fixing apparatuses mounted to electrophotographic copying machines and printers. This type of fixing apparatus includes a plate-like heater, a rotatable cylindrical film which is heated by the heater, and a holder that supports the rotation of the film. The fixing apparatus further includes a pressure roller that forms a nip portion with the heater, with the film therebetween, and a pressure stay that presses the holder against the pressure roller. A printing material that carries an unfixed toner image is heated while being nipped and conveyed through the nip portion, so that the toner image is fixed onto the printing material.

Fixing apparatuses of film heating type are required to make the glossiness of a toner image carried by calendared paper or the like serving as a printing material uniform in a direction perpendicular to the printing-material conveying direction. Japanese Patent Laid-Open No. 2007-33552 discloses a fixing apparatus in which a protruding portion protruding toward a pressure roller from a sliding surface of a heater with respect to the inner surface of a film in a direction perpendicular to a printing-material conveying direction is provided, at the nip portion of the holder, downstream from the heater in the printing-material conveying direction.

In the fixing apparatus of Japanese Patent Laid-Open No. 2007-33552, heat-resistant resin is used as the material of the holder in consideration of smoothness and wear because the holder rubs against the film. The holder is pressed by a metal pressure stay with higher rigidity to apply pressure to the pressure roller via the heater to thereby maintain a predetermined nip shape.

In the fixing apparatus of Japanese Patent Laid-Open No. 2007-33552, when the film rotates along with the rotation of the pressure roller, the holder receives a force from the film in the printing-material conveying direction, and the pressure stay receives a force in the printing-material conveying direction via the holder.

The fixing apparatus of film heating type is configured such that both ends of the pressure stay and the holder are supported by flanges for restricting the movement of the film in the direction perpendicular to the printing-material conveying direction. Therefore, when the pressure stay received a force in the printing-material conveying direction, the displacement amount (deflection amount) in the printing-material conveying direction is larger toward the center than at both ends of the pressure stay. At that time, the holder tends to increase in displacement amount in the printing-material conveying direction toward the center as compared with both ends of the holder according to the displacement amount of the pressure stay.

In such a case, the effect of the protruding portion of the holder is insufficient at the center of the holder. This may impair the glossiness of the toner image. This may also cause a difference in glossiness between the center and the ends of the holder, impairing the uniformity of the glossiness of the toner image.

SUMMARY

The present disclosure provides a fixing apparatus in which deflection of the support member is reduced or eliminated in a direction perpendicular to the printing-material conveying direction so that an image with highly uniform glossiness can be formed.

The present disclosure provides a fixing apparatus including a cylindrical rotating member, a guide member, a roller, and a stay. The guide member is in contact with an inner surface of the rotating member and is configured to guide rotation of the rotating member. The roller forms a nip portion together with the guide member, with the rotating member in between. The stay is disposed in a hollow portion of the rotating member and is configured to reinforce the guide member. An image carried by a printing material is fixed onto the printing material while the printing material is nipped and conveyed through the nip portion. The guide member has a contact surface that restricts a position of the guide member with respect to the stay by coming into contact with a surface of the stay on the upstream side in the printing-material conveying direction. The contact surface is disposed, in a direction perpendicular to the printing-material conveying direction, in such a manner that a center is downstream from ends in the printing-material conveying direction.

Further features of the present disclosure will become apparent from the following description of exemplary embodiments with reference to the attached drawings.

BRIEF DESCRIPTION OF THE DRAWINGS

FIG. 5A-1 is a diagram illustrating the positional relationship among the outer wall and the regulating ribs of a holder and the ribs of a pressure stay of a comparative example when the film is at rest, according to one or more embodiments of the subject disclosure.

FIG. 5A-2 is a diagram illustrating the positional relationship among the outer wall and the regulating ribs of the holder and the ribs of the pressure stay of the comparative example while the film is rotating, according to one or more embodiments of the subject disclosure.

FIG. 5B-1 is a diagram illustrating the positional relationship between the outer wall and the regulating rib of the holder and the rib of the pressure stay of the comparative example on the upstream side in the printing-material conveying direction while the film is rotating, according to one or more embodiments of the subject disclosure.

FIG. 5B-2 is a diagram illustrating the positional relationship between the outer wall and the regulating rib of the holder and the rib of the pressure stay of the comparative example on the downstream side while the film is rotating, according to one or more embodiments of the subject disclosure.

FIG. 6A-1 is a diagram illustrating the positional relationship among the outer wall and the regulating ribs of a holder and the ribs of a pressure stay of the first embodiment when the film is at rest, according to one or more embodiments of the subject disclosure.

FIG. 6A-2 is a diagram illustrating the positional relationship among the outer wall and the regulating ribs of the holder and the ribs of the pressure stay of the first embodiment while the film is rotating, according to one or more embodiments of the subject disclosure.

FIG. 6B-1-1 is a diagram illustrating the positioning state of an end of the holder in the longitudinal direction perpendicular to the printing-material conveying direction on the upstream side in the printing-material conveying direction, according to one or more embodiments of the subject disclosure.

FIG. 6B-1-2 is a diagram illustrating the positioning state of the center of the holder in the longitudinal direction on the upstream side, according to one or more embodiments of the subject disclosure.

FIG. 6B-2-1 is a diagram illustrating the positioning state of an end of the holder in the longitudinal direction on the downstream side, according to one or more embodiments of the subject disclosure.

FIG. 6B-2-2 is a diagram illustrating the positioning state of the center of the holder in the longitudinal direction on the downstream side, according to one or more embodiments of the subject disclosure.

FIG. 11B-1 is a diagram illustrating the positional relationship among the outer wall and the regulating ribs of the holder and the ribs of the pressure stay of the first embodiment, and the shape of the holder, with the film at rest, according to one or more embodiments of the subject disclosure.

FIG. 11B-2 is a diagram illustrating the positional relationship among the outer wall and the regulating ribs of the holder and the ribs of the pressure stay of the first embodiment, and the shape of the holder, while the film is rotating, according to one or more embodiments of the subject disclosure.

DESCRIPTION OF THE EMBODIMENTS

Embodiments of the present disclosure will be described hereinbelow with reference to the drawings. The embodiments of the present disclosure are given for illustrative only and are not intended to limit the present disclosure. The configurations of the embodiments can be replaced with other various configurations within the spirit of the present disclosure.

First Embodiment (1) Image Forming Apparatus 100

Figure 14:
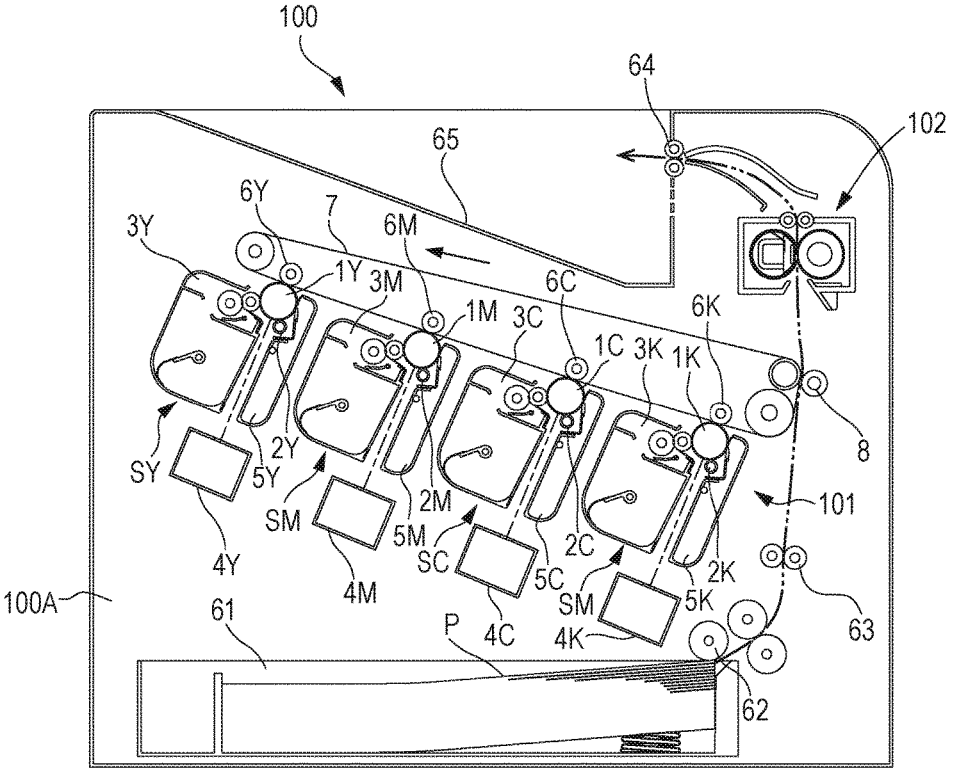
FIG. 14 is a cross-sectional view of an image forming apparatus, according to one or more embodiments of the subject disclosure.

Referring to FIG. 14, an image forming apparatus 100 according to the present embodiment will be described. FIG. 14 is a cross-sectional view of an image forming apparatus (in the present embodiment, a full-color printer) 100 using an electrophotographic printing technique illustrating, in outline, the configuration of thereof.

In the image forming apparatus 100, an image forming unit 101 that forms an image on a printing material P with toner includes four image forming stations SY, SM, SC, and SK of yellow, magenta, cyan, and black. The image forming stations SY, SM, SC, and SK respectively include photosensitive drums 1Y, 1M, 1C, and 1K serving as image bearing members, charging members 2Y, 2M, 2C, and 2K, and developing units 3Y, 3M, 3C, and 3K.

The image forming unit 101 further includes laser scanners 4Y, 4M, 4C, and 4K and cleaners 5Y, 5M, 5C, and 5K that clean the outer circumferential surfaces of the photosensitive drums 1Y, 1M, 1C, and 1K. The image forming unit 101 further includes transfer members 6Y, 6M, 6C, and 6K, a belt 7 that carries and conveys toner images transferred from the photosensitive drums 1Y, 1M, 1C, and 1K by the transfer members 6Y, 6M, 6C, and 6K, and a secondary transfer member 8 that transfers the toner images from the belt 7 to the printing material P.

Since the operation of the image forming unit 101 is well known, a detailed description thereof will be omitted.

The printing materials P housed in a cassette 61 in an apparatus main body 100A are fed one by one to a roller pair 63 by the rotation of a roller 62. Each printing material P is conveyed to a secondary transfer unit formed of the belt 7 and the secondary transfer member 8 by the rotation of the roller pair 63, and the toner images are transferred onto the printing material P at the secondary transfer unit. The printing material P carrying the unfixed toner image is sent to a fixing apparatus 102 serving as a fixing unit. The toner image is fixed by heating onto the printing material P by the fixing apparatus 102. The printing material P that has exited the fixing apparatus 102 is discharged onto a tray 65 by the rotation of a roller pair 64.

(2) Fixing Apparatus 102

Figure 1:
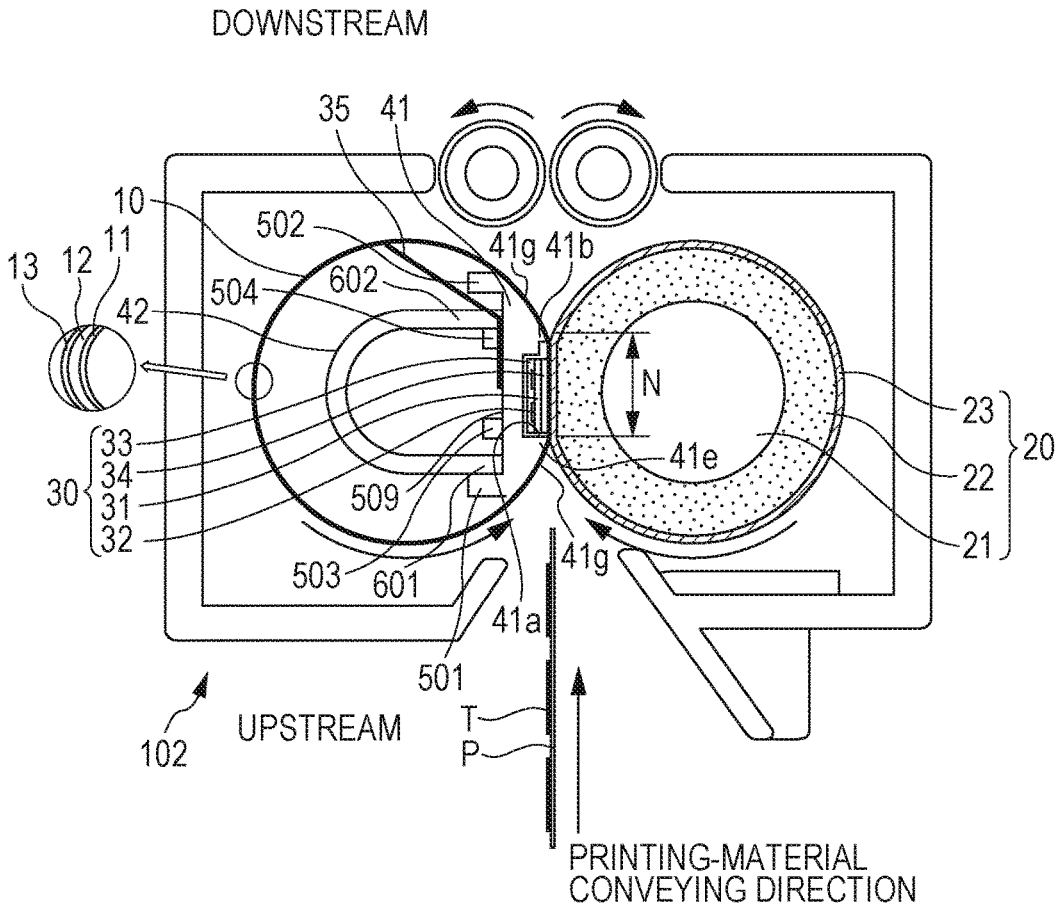
FIG. 1 is a cross-sectional view of a fixing apparatus according to a first embodiment illustrating, in outline, the configuration thereof.
Figure 2A:
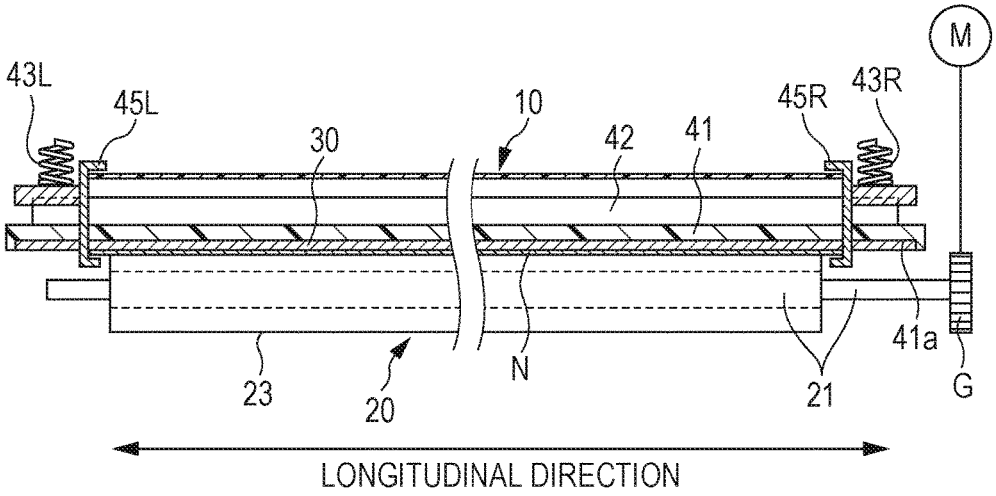
FIG. 2A is a cross-sectional view of the fixing apparatus viewed from the upstream side in a printing-material conveying direction, according to one or more embodiments of the subject disclosure.
Figure 2B:
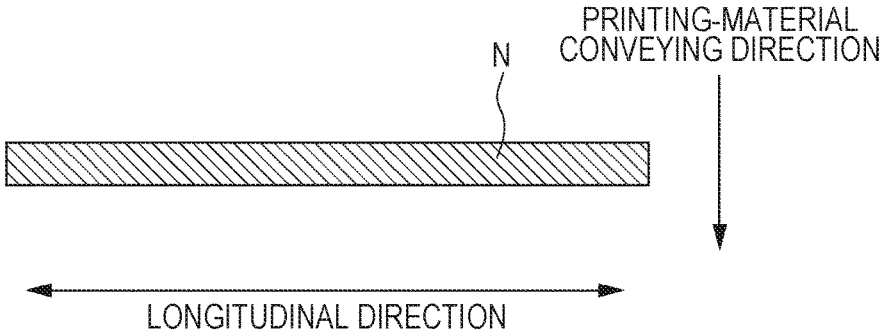
FIG. 2B is a diagram illustrating a nip portion, according to one or more embodiments of the subject disclosure.

The fixing apparatus 102 of the present embodiment will be described with reference to FIG. 1 and FIGS. 2A and 2B. FIG. 1 is a cross-sectional view of the film heating type fixing apparatus 102 illustrating, in outline, the configuration thereof. FIG. 2A is a cross-sectional view of the fixing apparatus 102 viewed from the upstream side in the printing-material conveying direction. FIG. 2B is a diagram illustrating a nip portion N viewed from a holder 41 side, with a film 10 at rest.

The fixing apparatus 102 of the present embodiment includes a plate-like ceramic heater (hereinafter, referred to as "heater") 30 and the film 10, which is a cylindrical rotating member, to be heated by the heater 30. The fixing apparatus 102 further includes the holder 41 serving as a support member that supports the heater 30 and a pressure roller 20 serving as a pressing rotatable member that forms the nip portion N with the holder 41 via the film 10. The fixing apparatus 102 further includes a pressure stay 42 serving as a pressure member that presses the holder 41 against the pressure roller 20 and flanges 45L and 45R that restrict movement of the film 10 in the longitudinal direction of the film 10. The holder 41 also serves as a guide member that guides the rotation of the film 10. The pressure stay 42 also serves as a reinforcement of the holder 41.

(2-1) Film 10

The film 10 includes an endless film-like base layer 11 made of a heat-resistant, flexible material and an elastic layer 12 formed on the outer circumferential surface of the base layer 11 with silicone rubber or the like. The film 10 further includes a releasing layer 13 on the outer circumferential surface of the elastic layer 12 to enhance the fixing performance and the image quality.

The elastic layer 12 wraps around an unfixed toner image T carried by the printing material P to uniformly apply heat to the toner image T. Excessively large thickness of the elastic layer 12 leads to large heat capacity. This increases the time taken to bring the temperature of the outer circumferential surface (surface) of the film 10 to a temperature necessary for fixing the toner image T to the printing material P, resulting in a decrease in on-demand property unique to the film heating type. For that reason, the elastic layer 12 preferably has a thickness of 50 μm or more and 500 μm or less.

The higher thermal conductivity of the elastic layer 12 is, the better, preferably, 0.5 W/m·K or more. To attain such thermal conductivity, a thermo-conductive filler, such as zinc oxide (ZnO), aluminum oxide ($Al_2O_3$), silicon carbide (SiC), or metal silicon, is mixed to the silicone rubber to control thermal conductivity.

The base layer 11 may be a thin, flexible endless belt made of metal, such as steel use stainless (SUS) or nickel (Ni) with high thermal conductivity. Alternatively, the base layer 11 may be a thin, flexible endless belt made of heat-resistant resin, such as polyimide, polyamide, or polyether ether ketone (PEEK).

The outer circumferential surface of the elastic layer 12 is coated with fluororesin, such as perfluoroalkoxy (PFA), polytetrafluoroethylene (PTFE), or fluorinated ethylene propylene (FEP), alone or blended, or a tube of the fluororesin alone or blended as the releasing layer 13. The thickness of the releasing layer 13 needs to be 5 μm or more from the viewpoint of durability. If the releasing layer 13 is too thick, thermal conductivity decreases, affecting the fixing performance. For that reason, the releasing layer 13 preferably has a thickness of 50 μm or less.

In the film 10 of the present embodiment, the base layer 11 is made of SUS. The base layer 11 has a thickness of 30 μm and an inside diameter of 30 mm. The elastic layer 12 is made of silicone rubber with a thermal conductivity of 1.3 W/(m·K) and has a thickness of 275 μm. The releasing layer 13 is a tube made of PFA. The thickness of the releasing layer 13 is 20 μm to obtain high fixing performance.

(2-2) Holder 41

The holder 41 disposed through the hollow portion of the film 10 is formed of heat-resistant resin, such as liquid crystal polymer, phenol resin, poly phenylene sulfide (PPS), or polyetheretherketone (PEEK). The holder 41 includes a recessed groove 41*a* and a protruding portion 41*b* extending in a direction perpendicular to the printing-material conveying direction (hereinafter, referred to as "longitudinal direction"), which are opposed to the pressure roller 20.

The holder 41 is configured to guide the rotation of the film 10 using an arc-shaped guide surface 41*g* provided upstream from the recessed groove 41*a* in the printing-material conveying direction and an arc-shaped guide surface 41*g* provided downstream from the protruding portion 41*b* in the printing-material conveying direction. The recessed groove 41*a* supports the heater 30. The detailed shape of the protruding portion 41*b* will be described later.

(2-3) Pressure Roller 20

The pressure roller 20 includes a metal core 21, an elastic layer 22 disposed on the outer circumferential surface of the metal core 21, and a releasing layer 23 disposed on the outer circumferential surface of the elastic layer 22. The elastic layer 22 is made of a general heat-resistant elastic rubber material, such as silicone rubber or fluororubber. The releasing layer 23 is made of single or blended fluororesin, such as PFA, PTFE, or FEP and coats the outer circumferential surface of the elastic layer 22. Alternatively, the outer circumferential surface of the elastic layer 22 is coated with a tube of the fluororesin alone or blended.

The pressure roller 20 of the present embodiment uses an iron metal core having a diameter of 22 mm as the metal core 21. The elastic layer 22 is made of silicone rubber having a thickness of 4 mm. The releasing layer 23 is a PFA tube having a thickness of 50 μm. The pressure roller 20 has an outside diameter of 30 mm. The outside diameter of the pressure roller 20 is fixed in the longitudinal direction perpendicular to the printing-material conveying direction (ϕ30 mm, in a straight form).

(2-4) Heater 30

The heater 30 includes an elongated substrate 31 extending in the longitudinal direction perpendicular to the printing-material conveying direction. Examples of the substrate 31 include a ceramic substrate made of alumina or aluminum nitride and a heat-resistant resin substrate made of polyimide, PPS, or liquid crystal polymer.

A resistive heat generating layer 32 made of a silver-palladium alloy (Ag/Pd), ruthenium oxide ($RuO_2$), or tantalum nitride (Ta2N), which generates heat when energized, is disposed on a surface opposite to the pressure roller 20 of the substrate 31 in the longitudinal direction perpendicular to the printing-material conveying direction. The resistive heat generating layer 32 is coated with a glass coat which is a protecting layer 33 for protecting the resistive heat generating layer 32 and ensuring insulation.

To provide the substrate 31 with high slidability with respect to the inner surface of the film 10, a sliding layer 34 is disposed on a surface of the substrate 31 adjacent to the pressure roller 20. The sliding layer 34 is made of heat-resistant resin such as polyimide or polyamidoimide or glass.

In the present embodiment, the substrate 31 of the heater 30 is 10 mm long in the printing-material conveying direction, 350 mm long in the longitudinal direction perpendicular to the printing-material conveying direction, and 0.6 mm thick.

(2-5) Pressure Stay 42 and Flanges 45L and 45R

The pressure stay 42 formed in U-shape in cross section with a rigid material such as metal is disposed on a planar portion 509 of the holder 41 opposite to the pressure roller 20, in the hollow portion of the film 10. The U-shaped cross section of the pressure stay 42 enhances the flexural rigidity of the holder 41 in the longitudinal direction perpendicular to the printing-material conveying direction.

As illustrated in FIG. 2A, the both ends of the holder 41 and the pressure stay 42 are supported by the left and right flanges 45L and 45R held by the frame (not shown) of the fixing apparatus 102 in the longitudinal direction perpendicular to the printing-material conveying direction. The both ends of the pressure stay 42 are pressed in a direction perpendicular to the generatrix of the film 10 by left and right pressure springs 43L and 43R serving as pressing units, so that the flanges 45L and 45R push down the holder 41 in the same direction.

This causes the holder 41 to press an edge 41*e* of the holder 41 on the upstream side in the printing-material conveying direction, the sliding layer 34 of the heater 30, and the protruding portion 41*b* of the holder 41 on the downstream side in the printing-material conveying direction against the inner surface of the film 10. This causes the outer circumferential surface (surface) of the film 10 to be brought into pressure-contact with the outer circumferential surface (surface) of the pressure roller 20, so that the elastic layer 22 of the pressure roller 20 is crushed and elastically deformed to form the nip portion N having a predetermined width (see FIG. 1) between the surface of the film 10 and the surface of the pressure roller 20. The shape of the nip portion N, with the film 10 at rest, is rectangular, as illustrated in FIG. 2B.

(2-6) Heating Fixing Operation

As illustrated in FIG. 2A, the driving force of a motor M is transmitted to the metal core 21 of the pressure roller 20 that is rotatably supported by the frame via a gear G, causing the pressure roller 20 to rotate in the direction of the arrow in FIG. 1. The film 10 is rotated with the rotation of the pressure roller 20 in the direction of the arrow in FIG. 1, with the inner surface of the film 10 in contact with the guide surface 41*g* and the edge 41*e* of the holder 41, the sliding layer 34 of the heater 30, and the protruding portion 41*b* of the holder 41.

When electrical power is supplied to the resistive heat generating layer 32 of the heater 30 from an alternating-current source (not shown), the resistive heat generating layer 32 generates heat to rapidly increase the temperature of the heater 30. A temperature control unit (not shown) acquires a temperature inside the film 10 detected by a thermistor 35, serving as a temperature detecting member, provided at the holder 41, and controls the amount of electric power to be supplied to the resistive heat generating layer 32 so that the detected temperature is kept at a predetermined fixing temperature (target temperature).

The printing material P carrying the unfixed toner image T is heated while being nipped and conveyed through the nip portion N, so that the toner image T is fixed onto the printing material P.

(2-7) Shape of Protruding Portion 41*b* of Holder 41

Figure 3A:
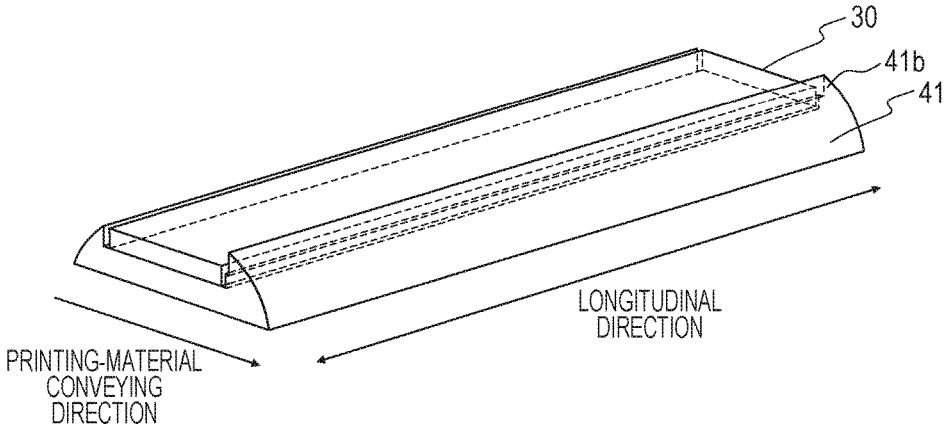
FIG. 3A is a perspective view of a holder obliquely viewed from a pressure roller side, according to one or more embodiments of the subject disclosure.
Figure 3B:
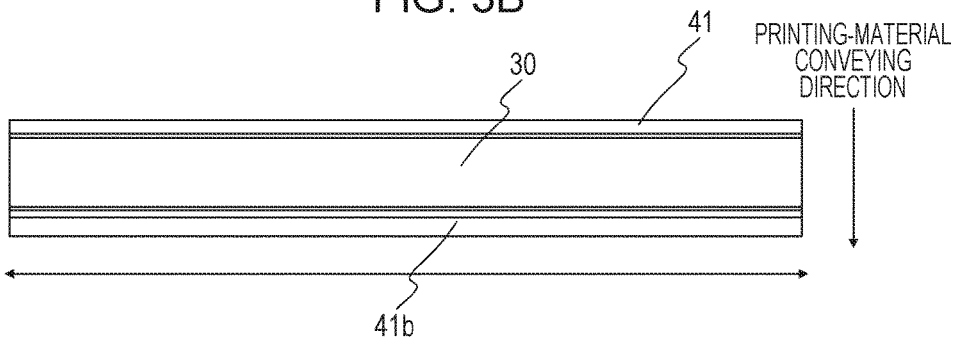
FIG. 3B is a diagram of the holder supporting a heater viewed from the pressure roller side, according to one or more embodiments of the subject disclosure.
Figure 3C:
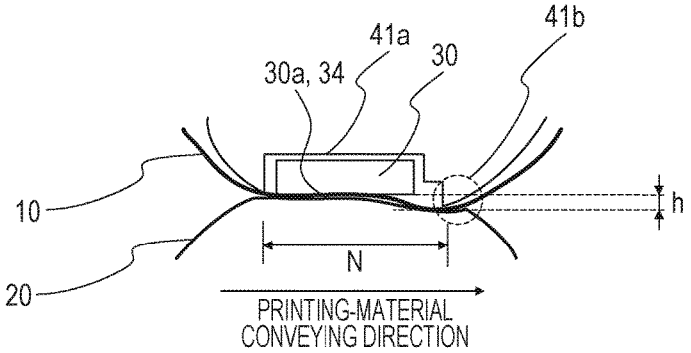
FIG. 3C is a diagram illustrating the protruding amount of the protruding portion of the holder, according to one or more embodiments of the subject disclosure.

FIGS. 3A, 3B, and 3C are diagrams for illustrating the shape of the protruding portion 41*b* of the holder 41. FIG. 3A is a perspective view of the holder 41 supporting the heater 30 obliquely viewed from the pressure roller 20 side. FIG. 3B is a diagram of the holder 41 supporting the heater 30 viewed from the pressure roller 20 side. FIG. 3C is a diagram illustrating a protruding amount h of the protruding portion 41*b* of the holder 41.

As illustrated in FIGS. 3A, 3B, and 3C, the protruding portion 41*b* provided at the holder 41 along the longitudinal direction perpendicular to the printing-material conveying direction is positioned on the downstream side of the nip portion N in the printing-material conveying direction. The protruding portion 41*b* protrudes toward the pressure roller 20 by the protruding amount h from a sliding surface 30*a* of the heater 30 with respect to the inner surface of the film 10. The protruding amount h is defined as the distance from the sliding layer 34 of the heater 30, which slides on the inner surface of the film 10 at a position lower than the protruding portion 41*b* of the holder 41, to the end of the protruding portion 41*b*. The protruding portion 41*b* is in alignment with the longitudinal direction perpendicular to the printing-material conveying direction when the film 10 is at rest.

In the present embodiment, the protruding amount h of the protruding portion 41*b* is 0.2 mm. The length of the protruding portion 41*b* in the longitudinal direction perpendicular to the printing-material conveying direction is 325 mm.

The protruding portion 41*b* is provided to provide high glossiness to an output image. In other words, providing the protruding portion 41*b* on the downstream side of the nip portion N in the printing-material conveying direction allows a fixed pressure to be applied to the toner image T on the printing material P, which is sufficiently softened by heat supplied from the heater 30 via the film 10. This allows the toner on the printing material P to be sufficiently melted for smooth expansion, providing high glossiness.

(3) Method for Positioning Holder 41 and Pressure Stay 42

A method for positioning the holder 41 and the pressure stay 42, which are features of the present embodiment, will be described.

When the film 10 rotates, the holder 41 receives a force in the printing-material conveying direction from the film 10. This causes the holder 41 to be positioned with respect to the high-rigidity pressure stay 42.

Figure 4A:
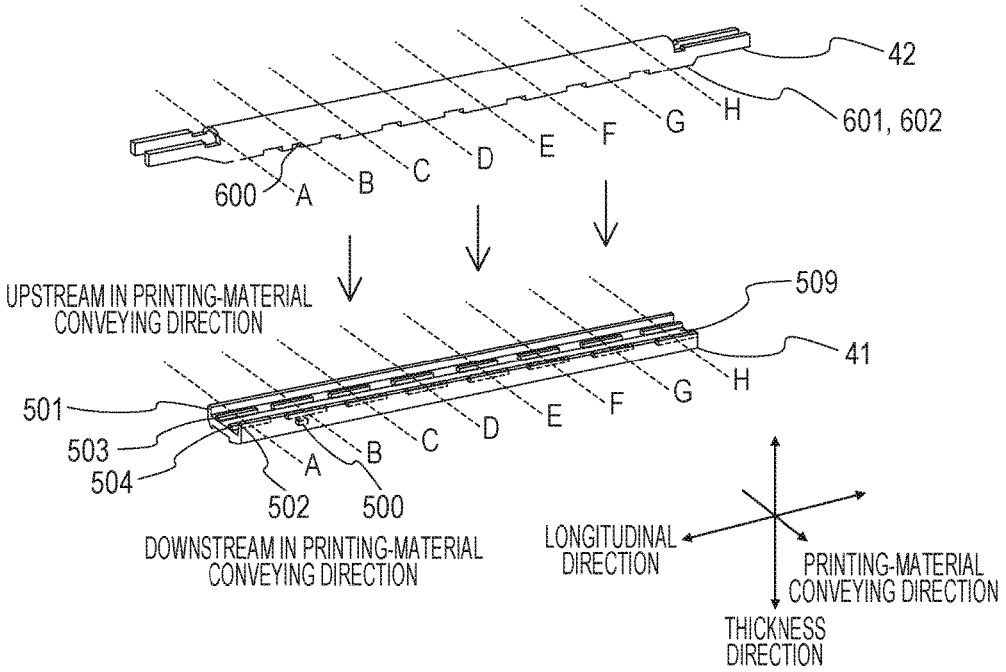
FIG. 4A is a perspective view of the holder and a pressure stay illustrating how they are assembled, according to one or more embodiments of the subject disclosure.
Figure 4B:
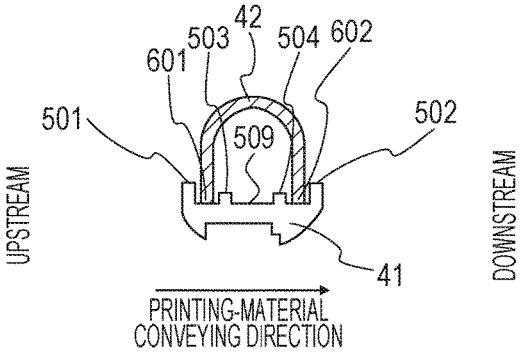
FIG. 4B is a cross-sectional view of the holder and the pressure stay after being assembled, according to one or more embodiments of the subject disclosure.

FIGS. 4A and 4B are diagrams for illustrating the method for positioning the holder 41 and the pressure stay 42 according to the present embodiment. FIG. 4A is a perspective view of the holder 41 and the pressure stay 42 illustrating how they are assembled. FIG. 4B is a cross-sectional view of the holder 41 and the pressure stay 42 after being assembled.

The pressure stay 42 is disposed on the planar portion 509 of the holder 41 from just above the planar portion 509 in the thickness direction of the holder 41 illustrated in FIG. 4A. The thickness direction is a direction perpendicular to the printing-material conveying direction and the longitudinal direction perpendicular to the printing-material conveying direction.

The positioning of the holder 41 to the pressure stay 42 is performed in the longitudinal direction perpendicular to the printing-material conveying direction and in the printing-material conveying direction.

The positioning in the longitudinal direction perpendicular to the printing-material conveying direction is performed by fitting a protruding rib 500 on the planar portion 509 of the holder 41 into a cutout portion 600 of the pressure stay 42 on the downstream side in the printing-material conveying direction.

The positioning in the printing-material conveying direction is performed by disposing ribs 601 provided on the pressure stay 42 on the upstream side in the printing-material conveying direction between an outer wall 501 and regulating ribs 503 provided on the planar portion 509, and disposing ribs 602 provided on the pressure stay 42 on the downstream side in the printing-material conveying direction between an outer wall 502 and regulating ribs 504 provided on the planar portion 509. The ribs 601 and 602 are disposed at eight places of the pressure stay 42, and the regulating ribs 503 and 504 are disposed at eight places of the holder 41 in the longitudinal direction perpendicular to the printing-material conveying direction. In other words, the positioning of the holder 41 and the pressure stay 42 is performed at two places on the upstream side and the downstream side in the printing-material conveying direction and eight places in the longitudinal direction perpendicular to the printing-material conveying direction (2×8=16 in total).

To specify the eight positions of the ribs 601 and 602 and the regulating ribs 503 and 504, the positions are denoted by reference signs A, B, C, D, E, F, G, and H.

The ribs 601 and the regulating ribs 503 on the upstream side in the printing-material conveying direction each have a length of 30 mm in the longitudinal direction perpendicular to the printing-material conveying direction. The interval between adjacent ribs 601 and the interval between adjacent regulating ribs 503 in the longitudinal direction perpendicular to the printing-material conveying direction are 10 mm.

The ribs 602 and the regulating ribs 504 on the downstream side in the printing-material conveying direction each have a length of 30 mm in the longitudinal direction perpendicular to the printing-material conveying direction. The interval between adjacent ribs 602 and the interval between adjacent regulating ribs 504 in the longitudinal direction perpendicular to the printing-material conveying direction are 10 mm.

The outer walls 501 and 502 protrude from the planar portion 509 of the holder 41 by 2 mm in the thickness direction of the holder 41. The regulating ribs 503 and 504 protrude from the planar portion 509 of the holder 41 by 1 mm in the thickness direction of the holder 41.

Figures 1, 5A:
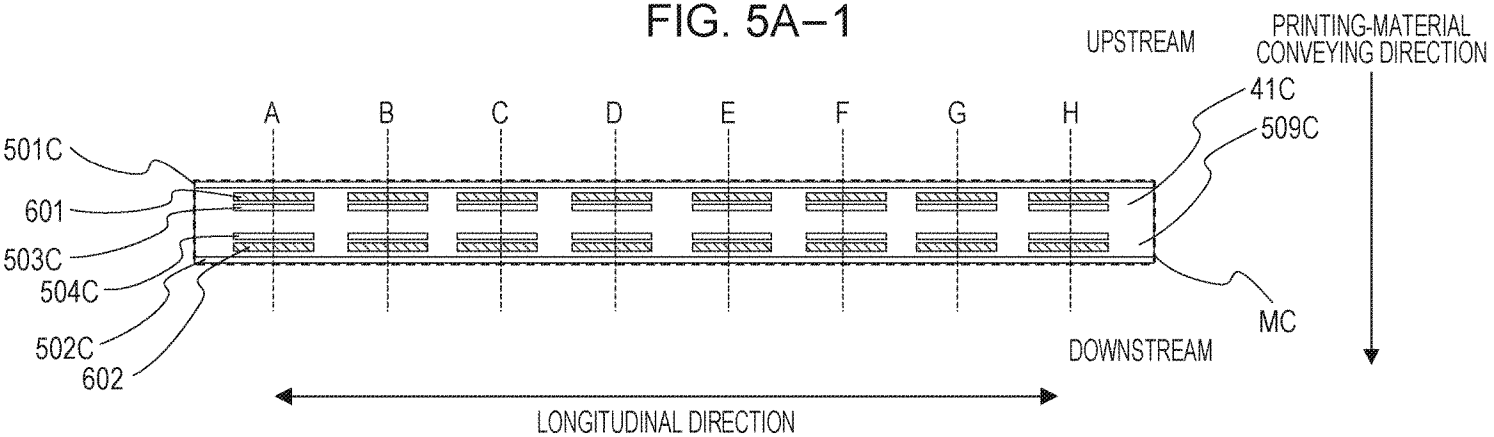

(3-1) Method for Positioning Holder 41C and Pressure Stay 42 of Comparative Example and Problem FIGS. 5A-1 and 5A-2 and FIGS. 5B-1 and 5B-2 are diagrams for illustrating a method for position a holder 41C and a pressure stay 42 of a comparative example. FIG. 5A-1 illustrates the positional relationship among outer walls 501C and 502C and regulating ribs 503C and 504C of the holder 41C and ribs 601 and 602 of the pressure stay 42 of the comparative example when the film 10 is at rest.

The ribs 601 and 602 of the pressure stay 42 are disposed on a planar portion 509C in such a manner as to be respectively disposed between the outer wall 501C and the regulating ribs 503C of the holder 41C and between the outer wall 502C and the regulating ribs 504C of the holder 41C. The outer walls 501C and 502C and the regulating ribs 503C and 504C are respectively aligned in the longitudinal direction perpendicular to the printing-material conveying direction. The shape MC of the holder 41C is rectangular as indicated by the thick broken line.

Figures 2, 5A:
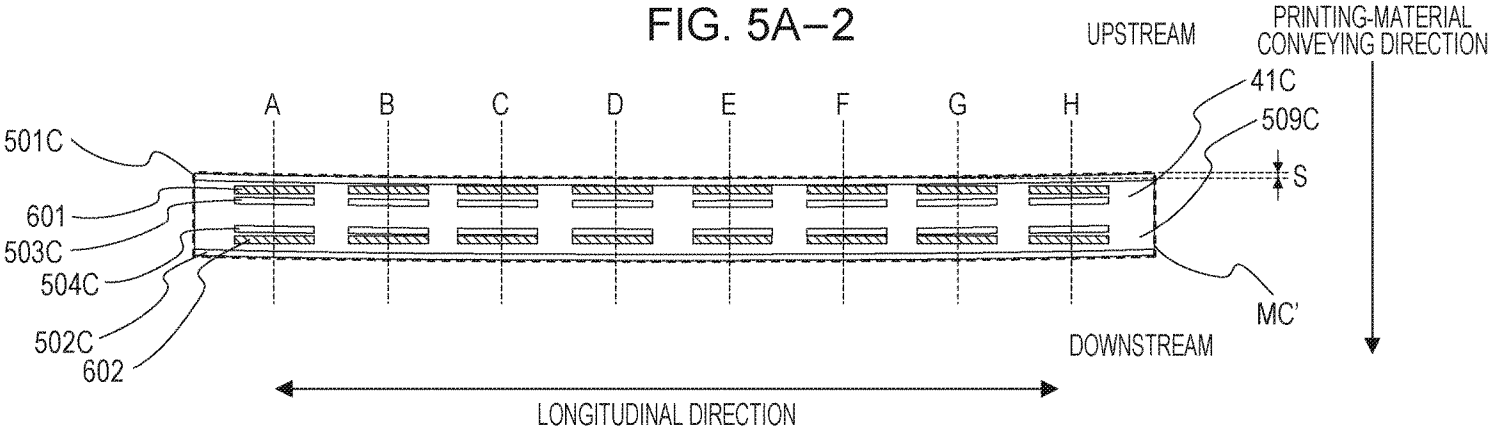
Figures 1, 5B:
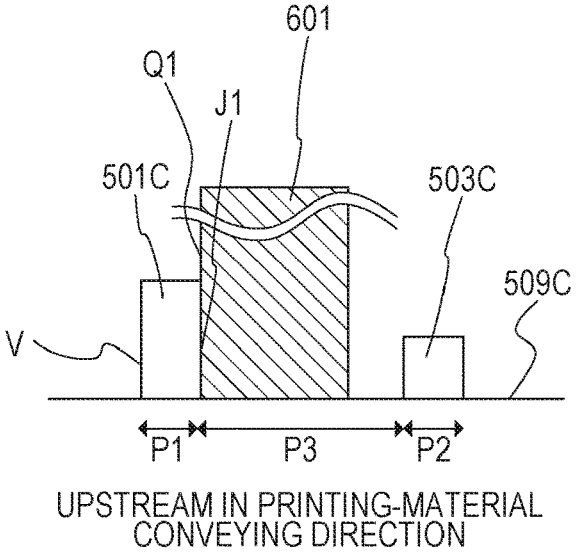
Figures 2, 5B:
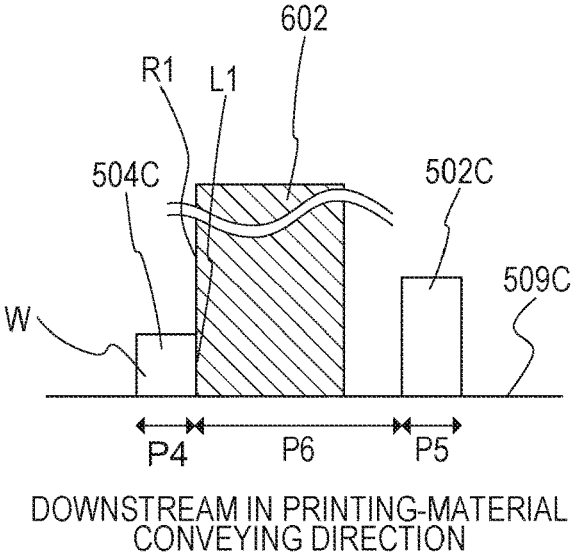

FIGS. 5B-1 and 5B-2 illustrate the positioning states of the holder 41 with respect to the pressure stay 42 while the film 10 is rotating.

On the upstream side in the printing-material conveying direction illustrated in FIG. 5B-1, when the holder 41C receives a force in the printing-material conveying direction from the film 10, a surface (contact surface) J1 of the outer wall 501C on the downstream side in the printing-material conveying direction comes into contact with a surface Q1 of each rib 601 on the upstream side in the printing-material conveying direction. Thus, the position of the holder 41C in the printing-material conveying direction with respect to the pressure stay 42 is restricted.

A surface (a reference surface) V of the outer wall 501C on the upstream side in the printing-material conveying direction, which is not in contact with the ribs 601, is at the same position across the printing-material conveying direction. Thus, the surface V extends in the longitudinal direction perpendicular to the printing-material conveying direction.

On the downstream side in the printing-material conveying direction illustrated in FIG. 5B-2, a surface (contact surface) L1 of each regulating rib 504C on the downstream side in the printing-material conveying direction comes into contact with a surface R1 of each rib 602 on the upstream side in the printing-material conveying direction. Thus, the position of the holder 41C with respect to the pressure stay 42 in the printing-material conveying direction is restricted.

Surfaces (reference surfaces) W of the plurality of regulating ribs 504C on the upstream side in the printing-material conveying direction, which are not in contact with the ribs 602, are at the same position in the printing-material conveying direction. Thus, the surfaces W are aligned in the longitudinal direction perpendicular to the printing-material conveying direction.

In FIG. 5B-1, reference sign P1 denotes the thickness of each outer wall 501C, P2 denotes the thickness of the regulating rib 503C, and P3 denotes the interval between each outer wall 501C and each regulating rib 503C. In FIG. 5B-2, reference sign P5 denotes the thickness of each outer wall 502C, P4 denotes the thickness of each regulating rib 504C, and P6 denotes the interval between each outer wall 502C and each regulating rib 504C. The thickness of the ribs 601 and 602 of the pressure stay 42 is 2.5 mm.

Table 1 illustrates the respective thicknesses P1 and P5 of the outer walls 501C and 502C, the respective thicknesses P2 and P4 of the regulating ribs 503C and 504C, the interval P3 between each outer wall 501C and each regulating rib 503C, and the interval P6 between each outer wall 502C and each regulating rib 504C in the printing-material conveying direction.

TABLE 1

| POSITION IN CONVEYING DIRECTION | ITEM | SIGN | LONGITUDINAL POSITION A | B | C | D | E | F | G | H |
|---|---|---|---|---|---|---|---|---|---|---|
| UPSTREAM | THICKNESS: OUTER WALL 501C | P1 | 2.0 | 2.0 | 2.0 | 2.0 | 2.0 | 2.0 | 2.0 | 2.0 |
| | INTERVAL: OUTER WALL 501C-RESRICTPING RIB 503C | P3 | 3.5 | 3.5 | 3.5 | 3.5 | 3.5 | 3.5 | 3.5 | 3.5 |
| | THICKNESS: RESTRICTING RIB 503C | P2 | 2.0 | 2.0 | 2.0 | 2.0 | 2.0 | 2.0 | 2.0 | 2.0 |
| DOWNSTREAM | THICKNESS: RESTRICTING RIB 504C | P4 | 2.0 | 2.0 | 2.0 | 2.0 | 2.0 | 2.0 | 2.0 | 2.0 |
| | INTERVAL: OUTER WALL 502C-RESTRICTING RIB 504C | P6 | 3.5 | 3.5 | 3.5 | 3.5 | 3.5 | 3.5 | 3.5 | 3.5 |
| | THICKNESS: OUTER WALL 502C | P5 | 2.0 | 2.0 | 2.0 | 2.0 | 2.0 | 2.0 | 2.0 | 2.0 |

FIG. 5A-2 illustrates the positional relationship among the outer walls 501C and 502C and the regulating ribs 503C and 504C of the holder 41C and the ribs 601 and 602 of the pressure stay 42 while the film 10 is rotating.

When the holder 41C receives a force in the printing-material conveying direction from the film 10, the holder 41C is deflected in a curve shape MC' as indicated by the thick broken line. In other words, since the both ends of the holder 41C are supported by the flanges 45L and 45R in the longitudinal direction perpendicular to the printing-material conveying direction, the displacement amount (hereinafter referred to as "deflection amount") of the holder 41C is small at the both ends and large at the center.

The deflection amount S of the holder 41C illustrated in FIG. 5A-2 is the difference in deflection amount between the ends and the center of the holder 41C in the printing-material conveying direction. The difference is about 0.3 mm. The deflection amount S is assumed to be positive when the deflection amount S is larger at the center than at the ends of the holder 41C. The deflection amount S of the holder 41C depends on the deflection amount of the pressure stay 42. In other words, since the pressure stay 42 made of metal has higher rigidity than the resin holder 41C, the holder 41C is deflected according to the deflection of the pressure stay 42.

Figure 7A:
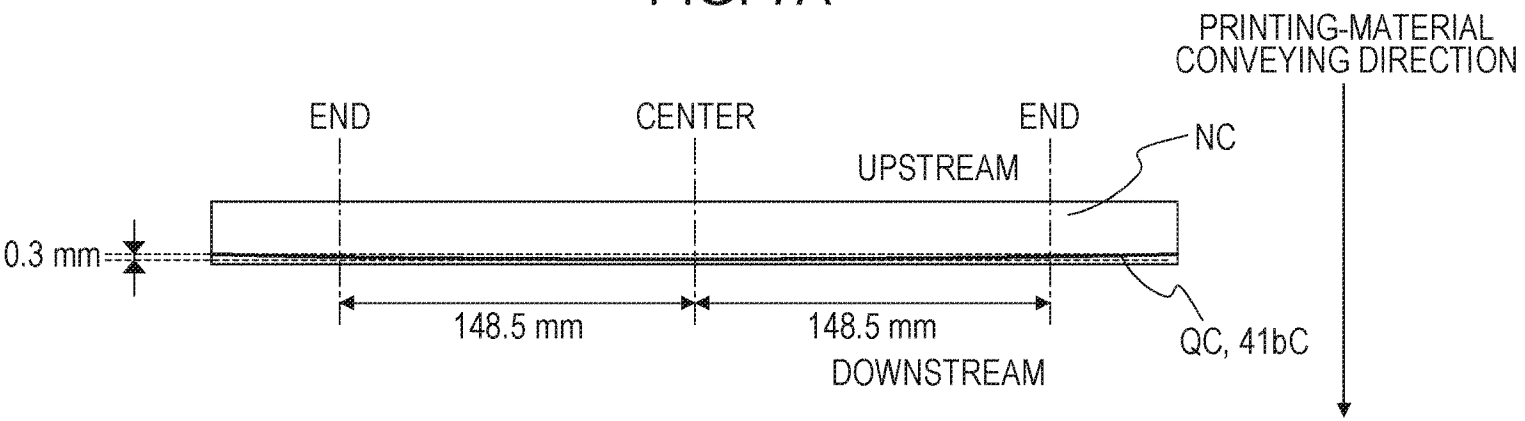
FIG. 7A is a diagram illustrating the shape of deflection of the holder of the comparative example, according to one or more embodiments of the subject disclosure.

FIG. 7A illustrates the relationship between the holder 41C and a nip portion NC of the comparative example in the longitudinal direction perpendicular to the printing-material conveying direction.

When the holder 41C of the comparative example deflects, the position QC of a protruding portion 41*b*C is influenced by the deflection. Therefore, the position QC of the protruding portion 41*b*C at the center of the holder 41C is shifted downstream in the printing-material conveying direction by about 0.3 mm from the position QC at the ends. The center of the holder 41C is the center of conveyance of the printing material P, and the ends is 148.5 mm away from the center (both ends of the printing material P of A4 size passing through the nip portion NC in landscape orientation).

Figure 8A:
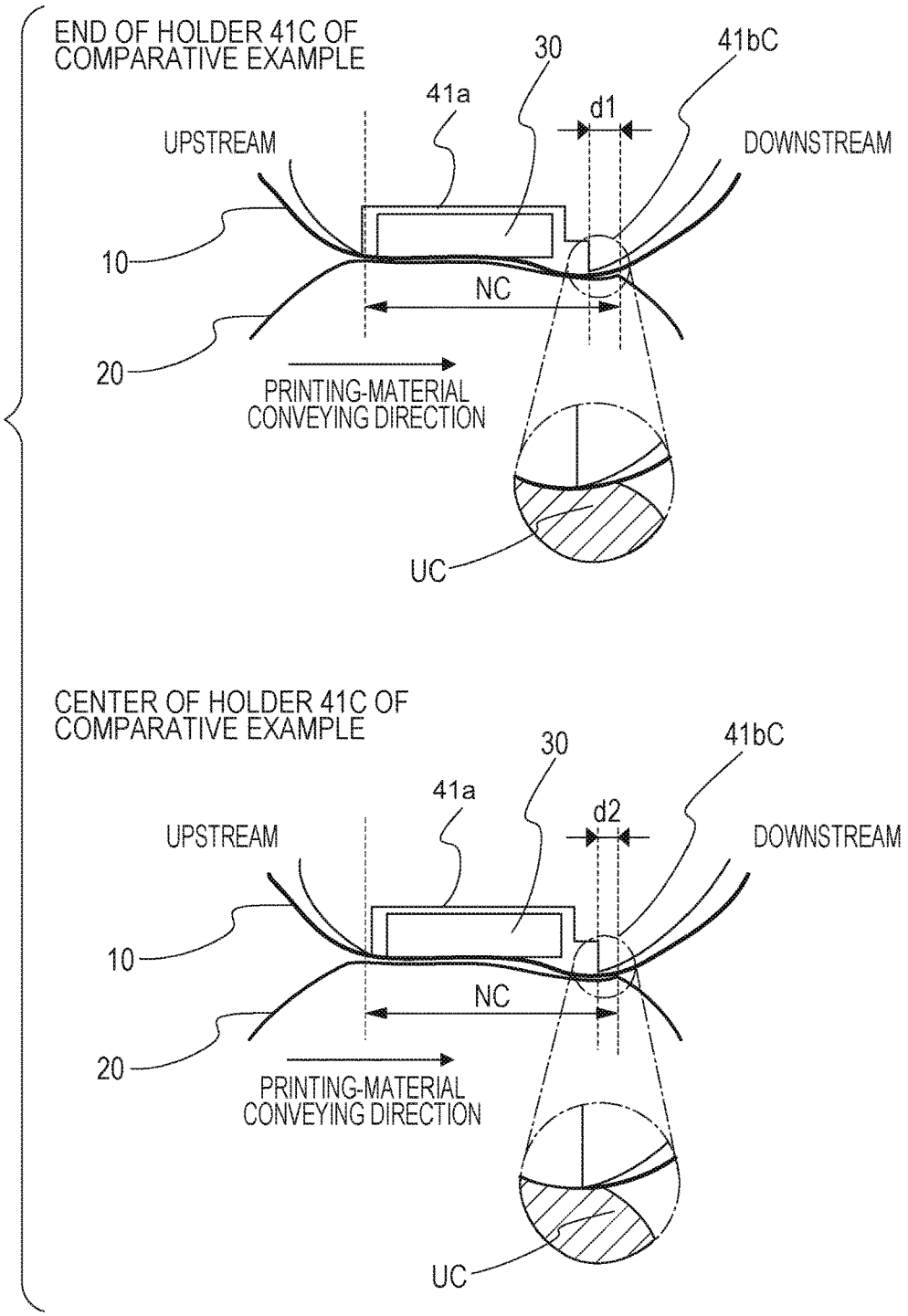
FIG. 8A is a diagram illustrating the amount of intrusion of a film to the pressure roller due to the protruding portion of the holder of the comparative example, according to one or more embodiments of the subject disclosure.

FIG. 8A illustrates the shape of the nip portion NC corresponding to the ends of the holder 41C of the comparative example and the shape of the nip portion NC corresponding to the center of the holder 41C in the longitudinal direction perpendicular to the printing-material conveying direction.

Since the position of the protruding portion 41*b*C at the center is shifted downstream in the printing-material conveying direction from the position at the ends, the distance d1 between the trailing end of the nip portion NC and the protruding portion 41*b*C at the ends is smaller than the distance d2 at the center, so that the amount UC of intrusion of the film 10 to the pressure roller 20 due to the protruding portion 41*b*C is smaller at the center. Thus, the pressing force of the protruding portion 41*b*C is smaller at the center of the holder 41C.

Figure 9A:
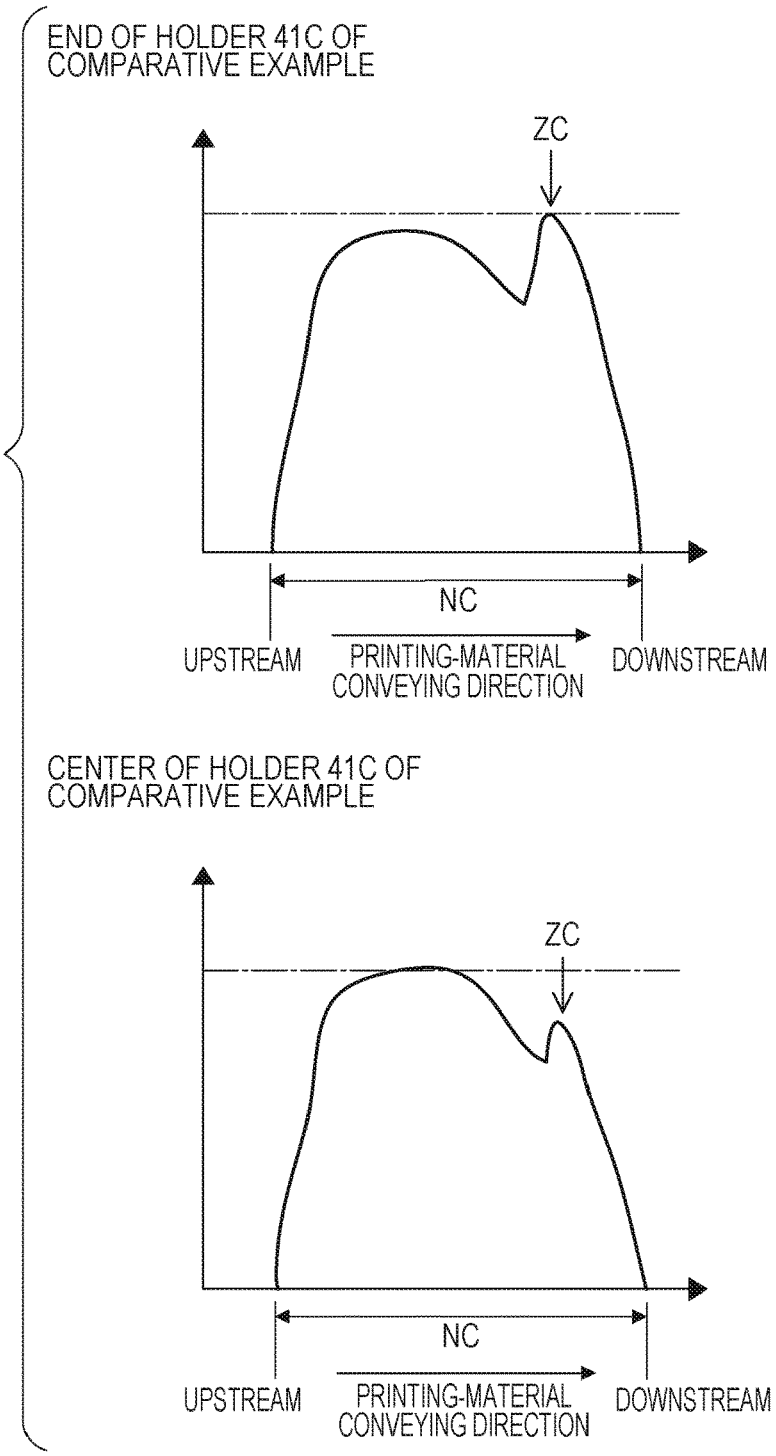
FIG. 9A is a diagram illustrating a pressing force peak due to the protruding portion of the holder of the comparative example, according to one or more embodiments of the subject disclosure.

FIG. 9A illustrates a pressing force distribution at the nip portion NC in the printing-material conveying direction at the ends of the holder 41C in the longitudinal direction and a pressing force distribution at the nip portion NC in the printing-material conveying direction at the center of the holder 41C in the longitudinal direction in the case where the holder 41C of the comparative example is used.

The nip portion NC corresponding to the ends of the holder 41C has an ideal pressing force distribution in which a high pressing force peak ZC is on the downstream side in the printing-material conveying direction because of the action of the protruding portion 41*b*C of the holder 41C. In contrast, the nip portion NC corresponding to the center of the holder 41C has an extremely lower pressing force peak ZC than the peak ZC at the ends because the protruding portion 41*b*C of the holder 41C has moved downstream in the printing-material conveying direction.

Figure 10A:
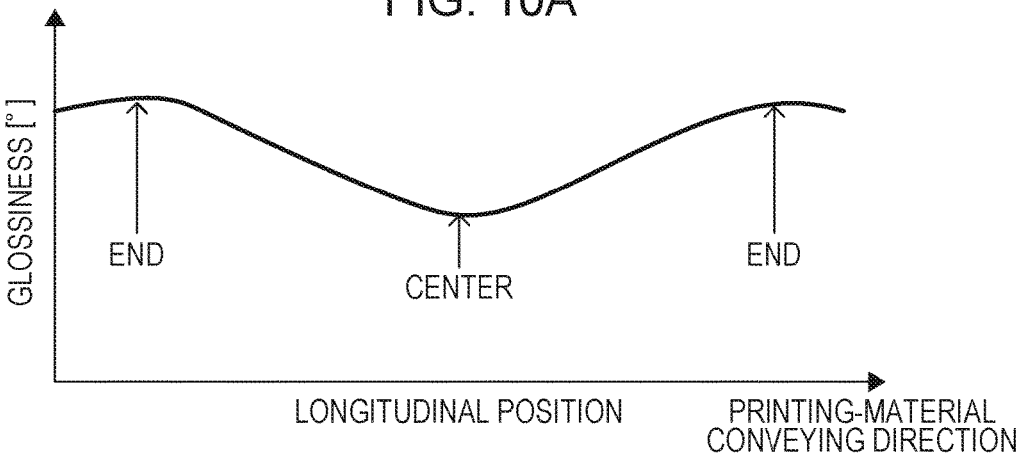
FIG. 10A is a diagram illustrating the distribution of the glossiness of a toner image when the holder of the comparative example is used, according to one or more embodiments of the subject disclosure.

FIG. 10A illustrates the distribution of the glossiness of the toner image T in the longitudinal direction perpendicular to the printing-material conveying direction when the holder 41C of the comparative example is used.

How the glossiness is evaluated will be described. Calendered paper of letter size (width in the longitudinal direction perpendicular to the printing-material conveying direction: 279 mm, width in the printing-material conveying direction: 216 mm) is used as the printing material P and passed through the nip portion N.

The glossiness is high at the ends of the holder 41C because the pressing force peak ZC (see the diagram on the left side of FIG. 9A) is on the downstream side in the printing-material conveying direction of the nip portion NC. In contrast, the glossiness is lower at the center of the holder 41C than at the ends of the holder 41C because there is no pressing force peak ZC (see the diagram on the right side of FIG. 9A) on the downstream side in the printing-material conveying direction in the nip portion NC. Thus, the glossiness on the surface of the calendered paper is uneven in the longitudinal direction perpendicular to the printing-material conveying direction. These effects may be more prominently when calendered paper such as gloss paper is used, which may lower user satisfaction.

Figures 1, 6A:
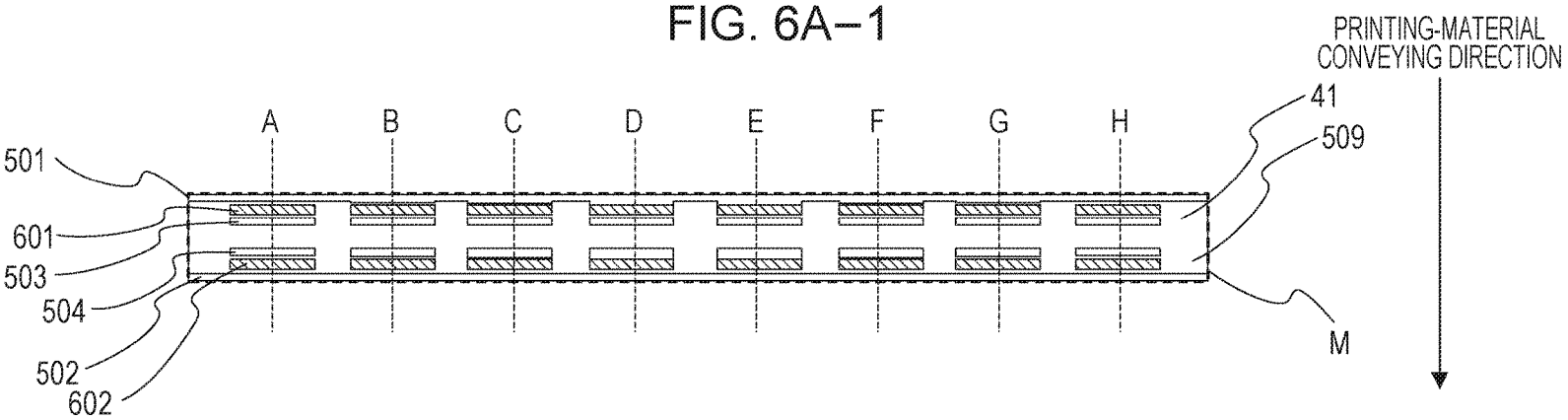
Figures 2, 6A:
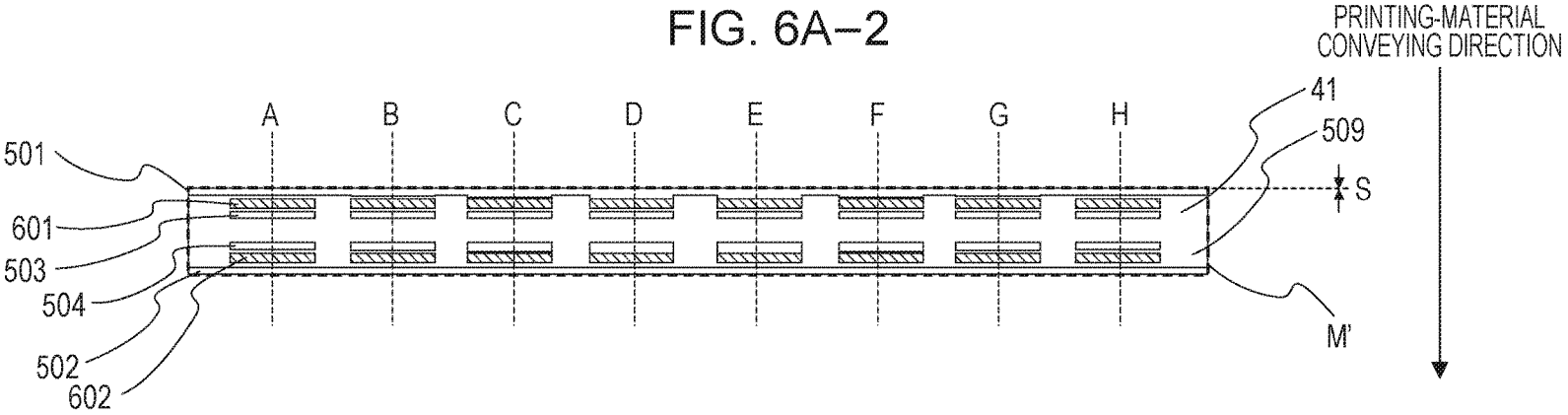

(3-2) Method for Positioning Holder 41 and Pressure Stay 42 of the Present Embodiment and Advantages Thereof FIGS. 6A-1, 6A-2, 6B-1-1, 6B-1-2, 6B-2-1, and 6B-2-2 are diagrams for illustrating a method for positioning the holder 41 and the pressure stay 42 of the present embodiment. FIG. 6A-1 illustrates the positional relationship among the outer walls 501 and 502 and the regulating ribs 503 and 504 of the holder 41 and the ribs 601 and 602 of the pressure stay 42 of the present embodiment, with the film 10 at rest.

The ribs 601 and 602 of the pressure stay 42 are disposed on a planar portion 509 in such a manner as to be respectively disposed between the outer wall 501 and the regulating ribs 503 of the holder 41 and between the outer wall 502 and the regulating ribs 504 of the holder 41. The shape M of the holder 41 is rectangular as indicated by the thick broken line.

Figures 1, 6B:
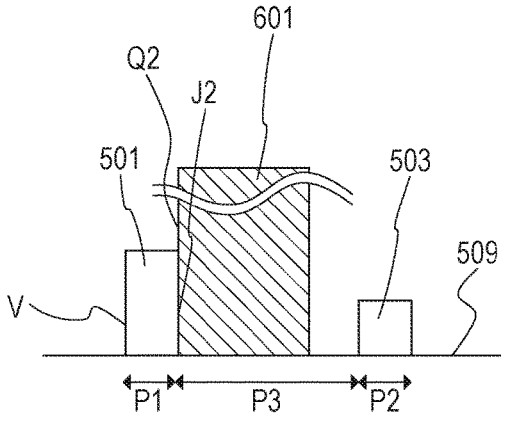
Figures 1, 2, 6B:
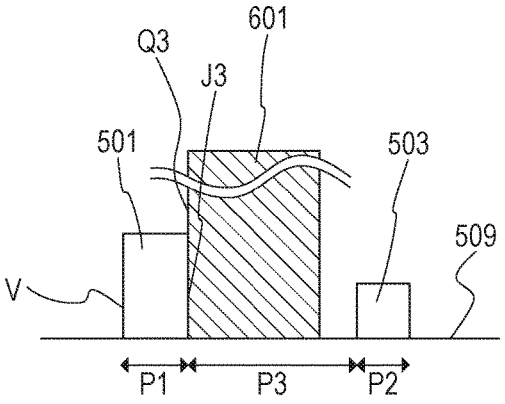
Figures 1, 2, 6B:
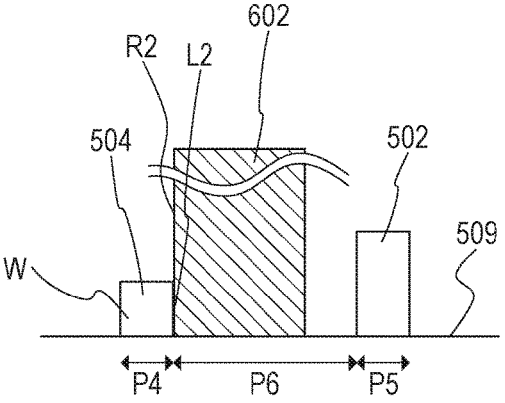
Figures 2, 6B:
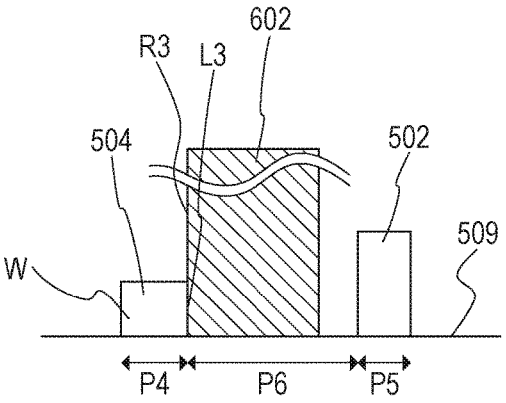

FIGS. 6B-1-1, 6B-1-2, 6B-2-1, and 6B-2-2 illustrate the positioning states of the holder 41 with respect to the pressure stay 42 while the film 10 is rotating.

FIG. 6B-1-1 illustrates the positioning state of an end of the holder 41 in the longitudinal direction perpendicular to the printing-material conveying direction on the upstream side in the printing-material conveying direction. FIG. 6B-1-2 illustrates the positioning state of the center of the holder 41 in the longitudinal direction perpendicular to the printing-material conveying direction on the upstream side in the printing-material conveying direction. FIG. 6B-2-1 illustrates the positioning state of an end of the holder 41 in the longitudinal direction perpendicular to the printing-material conveying direction on the downstream side in the printing-material conveying direction. FIG. 6B-2-2 illustrates the positioning state of the center of the holder 41 in the longitudinal direction perpendicular to the printing-material conveying direction on the downstream side in the printing-material conveying direction.

The ribs 601 of the pressure stay 42 on the upstream side in the printing-material conveying direction are each disposed on the planar portion 509 in such a manner as to be positioned between each outer wall 501 and each regulating rib 503 of the holder 41, as illustrated in FIGS. 6B-1-1 and 6B-1-2. The ribs 602 of the pressure stay 42 on the downstream side in the printing-material conveying direction are each disposed on the planar portion 509 in such a manner as to be positioned between each outer wall 502 and each regulating rib 504 of the holder 41, as illustrated in FIGS. 6B-2-1 and 6B-2-2.

Table 2 illustrates the respective thicknesses P1 and P5 of the outer walls 501 and 502, the respective thicknesses P2 and P4 of the regulating ribs 503 and 504 of the holder 41 of the present embodiment, the interval P3 between each outer wall 501 and each regulating rib 503, and the interval P6 between each outer wall 502 and each regulating rib 504 in the printing-material conveying direction.

TABLE 2

| POSITION IN CONVEYING DIRECTION | ITEM | SIGN | LONGITUDINAL POSITION A | B | C | D | E | F | G | H |
|---|---|---|---|---|---|---|---|---|---|---|
| UPSTREAM | THICKNESS: OUTER WALL 501 | P1 | 2.0 | 2.1 | 2.3 | 2.5 | 2.5 | 2.3 | 2.1 | 2.0 |
| | INTERVAL: OUTER WALL501-RESRICTPING RIB 503 | P3 | 3.5 | 3.4 | 3.2 | 3.0 | 3.0 | 3.2 | 3.4 | 3.5 |
| | THICKNESS: RESTRICTING RIB 503 | P2 | 2.0 | 2.0 | 2.0 | 2.0 | 2.0 | 2.0 | 2.0 | 2.0 |
| DOWNSTREAM | THICKNESS: RESTRICTING RIB 504 | P4 | 2.0 | 2.1 | 2.3 | 2.5 | 2.5 | 2.3 | 2.1 | 2.0 |
| | INTERVAL: OUTER WALL 502-RESTRICTING RIB 504 | P6 | 3.5 | 3.4 | 3.2 | 3.0 | 3.0 | 3.2 | 3.4 | 3.5 |
| | THICKNESS: OUTER WALL 502 | P5 | 2.0 | 2.0 | 2.0 | 2.0 | 2.0 | 2.0 | 2.0 | 2.0 |

As Table 2 shows, the outer wall 501 on the upstream side in the printing-material conveying direction is formed such that the thickness P1 in the printing-material conveying direction increases toward the downstream side in the printing-material conveying direction with a decreasing distance from the center in the longitudinal direction perpendicular to the printing-material conveying direction, as compared with the comparative example shown in Table 1. The interval P3 between the outer wall 501 and the regulating ribs 503 on the upstream side in the printing-material conveying direction is decreased with a decreasing distance from the center in the longitudinal direction perpendicular to the printing-material conveying direction, as compared with the comparative example shown in Table 1.

The regulating ribs 504 on the downstream side in the printing-material conveying direction are formed such that the thickness P4 in the printing-material conveying direction increases toward the downstream side in the printing-material conveying direction with a decreasing distance from the center in the longitudinal direction perpendicular to the printing-material conveying direction, as compared with the comparative example shown in Table 1. The interval P6 between the outer wall 502 on the downstream side in the printing-material conveying direction and the regulating ribs 504 is decreased with a decreasing distance from the center in the longitudinal direction perpendicular to the printing-material conveying direction, as compared with the comparative example shown in Table 1.

At the ends on the upstream side in the printing-material conveying direction illustrated in FIG. 6B-1-1, when the holder 41 receives a force in the printing-material conveying direction from the film 10, a surface (contact surface) J2 of each outer wall 501 on the downstream side in the printing-material conveying direction comes into contact with a surface Q2 of each rib 601 on the upstream side in the printing-material conveying direction. Thus, the position of the holder 41 at the ends in the printing-material conveying direction with respect to the pressure stay 42 is restricted.

At the center on the upstream side in the printing-material conveying direction illustrated in FIG. 6B-1-2, a surface (contact surface) J3 of each outer wall 501 on the downstream side in the printing-material conveying direction comes into contact with a surface Q3 of each rib 601 on the upstream side in the printing-material conveying direction. Thus, the position of the holder 41 at the center in the printing-material conveying direction with respect to the pressure stay 42 is restricted.

A surface (a reference surface) V of the outer wall 501 on the upstream side in the printing-material conveying direction, which is not in contact with the ribs 601, is at the same position across the printing-material conveying direction. Thus, the surface V extends in the longitudinal direction perpendicular to the printing-material conveying direction.

At the ends on the downstream side in the printing-material conveying direction illustrated in FIG. 6B-2-1, a surface (contact surface) L2 of each regulating rib 504 on the downstream side in the printing-material conveying direction comes into contact with a surface R2 of each rib 602 on the upstream side in the printing-material conveying direction. Thus, the position of the holder 41 with respect to the pressure stay 42 in the printing-material conveying direction is restricted.

At the center on the downstream side in the printing-material conveying direction illustrated in FIG. 6B-2-2, a surface (contact surface) L3 of each regulating rib 504 on the downstream side in the printing-material conveying direction comes into contact with a surface R3 of each rib 602 on the upstream side in the printing-material conveying direction. Thus, the position of the holder 41C with respect to the pressure stay 42 in the printing-material conveying direction is restricted.

Surfaces (reference surfaces) W of the plurality of regulating ribs 504 on the upstream side in the printing-material conveying direction, which are not in contact with the ribs 602, are at the same position in the printing-material conveying direction. Thus, the surfaces W are aligned in the longitudinal direction perpendicular to the printing-material conveying direction.

The thicknesses in the printing-material conveying direction of the outer wall 501 having the contact surfaces J2 and J3 and the regulating ribs 504 having the contact surfaces L2 and L3 are increased toward the downstream side in the printing-material conveying direction with a decreasing distance from the center in the longitudinal direction perpendicular to the printing-material conveying direction. Therefore, with the film 10 at rest, the contact surface J3 of each outer wall 501 at the center is positioned downstream in the printing-material conveying direction from the contact surface J2 at the ends, and the contact surface L3 of each regulating rib 504 at the center is positioned downstream from the contact surface L2 at the ends in the printing-material conveying direction.

FIG. 6A-2 illustrates the positional relationship among the outer walls 501 and 502 and the regulating ribs 503 and 504 of the holder 41 and the ribs 601 and 602 of the pressure stay 42 while the film 10 is rotating.

Even if the holder 41 receives a force in the printing-material conveying direction from the film 10, the shape M' of the holder 41 indicated by the thick broken line is substantially the same as the shape M with the film 10 at rest illustrated in FIG. 6A-1 (deflection amount S in the longitudinal direction perpendicular to the printing-material conveying direction=0). This is because the contact surfaces J3 and L3 of the outer wall 501 and the regulating rib 504 of the holder 41 at the center are formed downstream from the contact surfaces J2 and L2 at the end in the printing-material conveying direction.

Figure 7B:
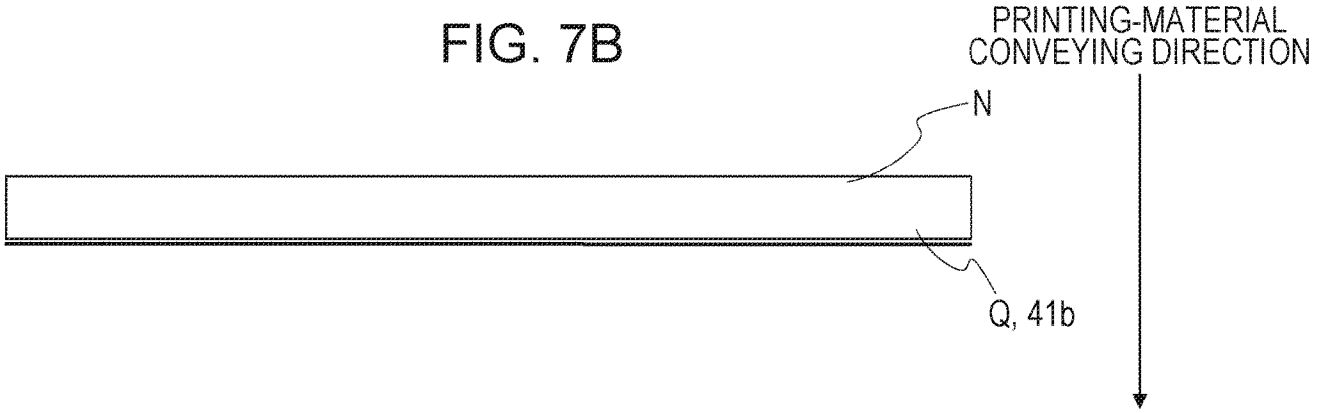
FIG. 7B is a diagram illustrating the relationship between the holder and the nip portion of the first embodiment in the longitudinal direction perpendicular to the printing-material conveying direction, according to one or more embodiments of the subject disclosure.

FIG. 7B illustrates the relationship between the holder 41 and the nip portion N of the present embodiment in the longitudinal direction perpendicular to the printing-material conveying direction.

The holder 41 of the present embodiment has almost no deflection. Therefore, in the longitudinal direction perpendicular to the printing-material conveying direction, the position Q of the protruding portion 41*b* also has almost no deflection in the printing-material conveying direction at the ends and the center of the holder 41.

Figure 8B:
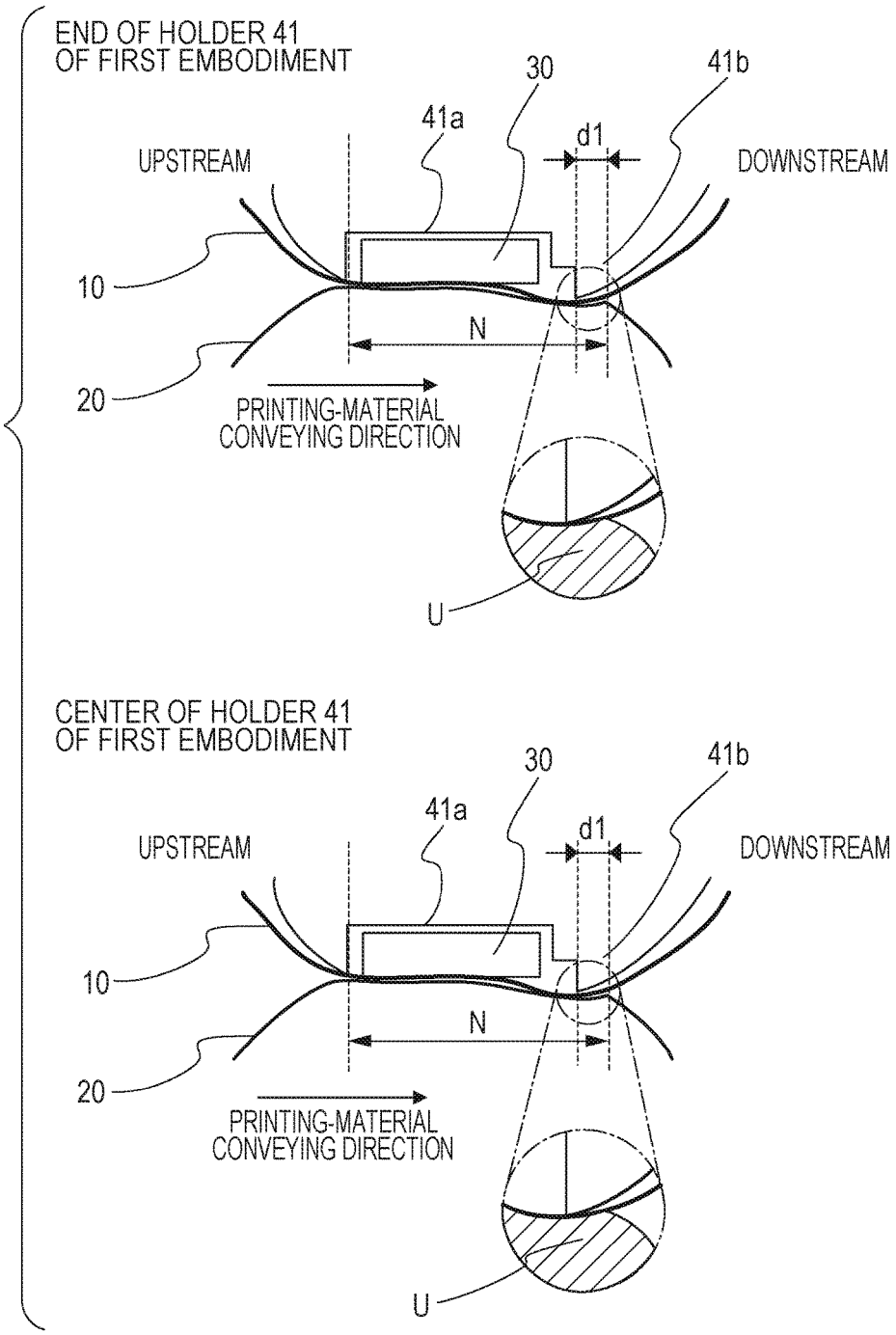
FIG. 8B is a diagram illustrating the amount of intrusion of a film to the pressure roller due to the protruding portion of the holder of the first embodiment, according to one or more embodiments of the subject disclosure.

FIG. 8B illustrates the shape of the nip portion N corresponding to the ends of the holder 41 of the present embodiment and the shape of the nip portion N corresponding to the center of the holder 41 in the longitudinal direction perpendicular to the printing-material conveying direction.

Since there is almost no displacement of the protruding portion 41*b* toward the downstream side in the printing-material conveying direction at the ends and the center, the distance between the trailing end of the nip portion N and the protruding portion 41*b*at the ends and at the center are d1. Taking this result, the amount U of intrusion of the film 10 to the pressure roller 20 due to the protruding portion 41*b* at the ends and the amount U of intrusion of the fill 10 to the pressure roller 20 due to the protruding portion 41*b*at the center are the same.

Figure 9B:
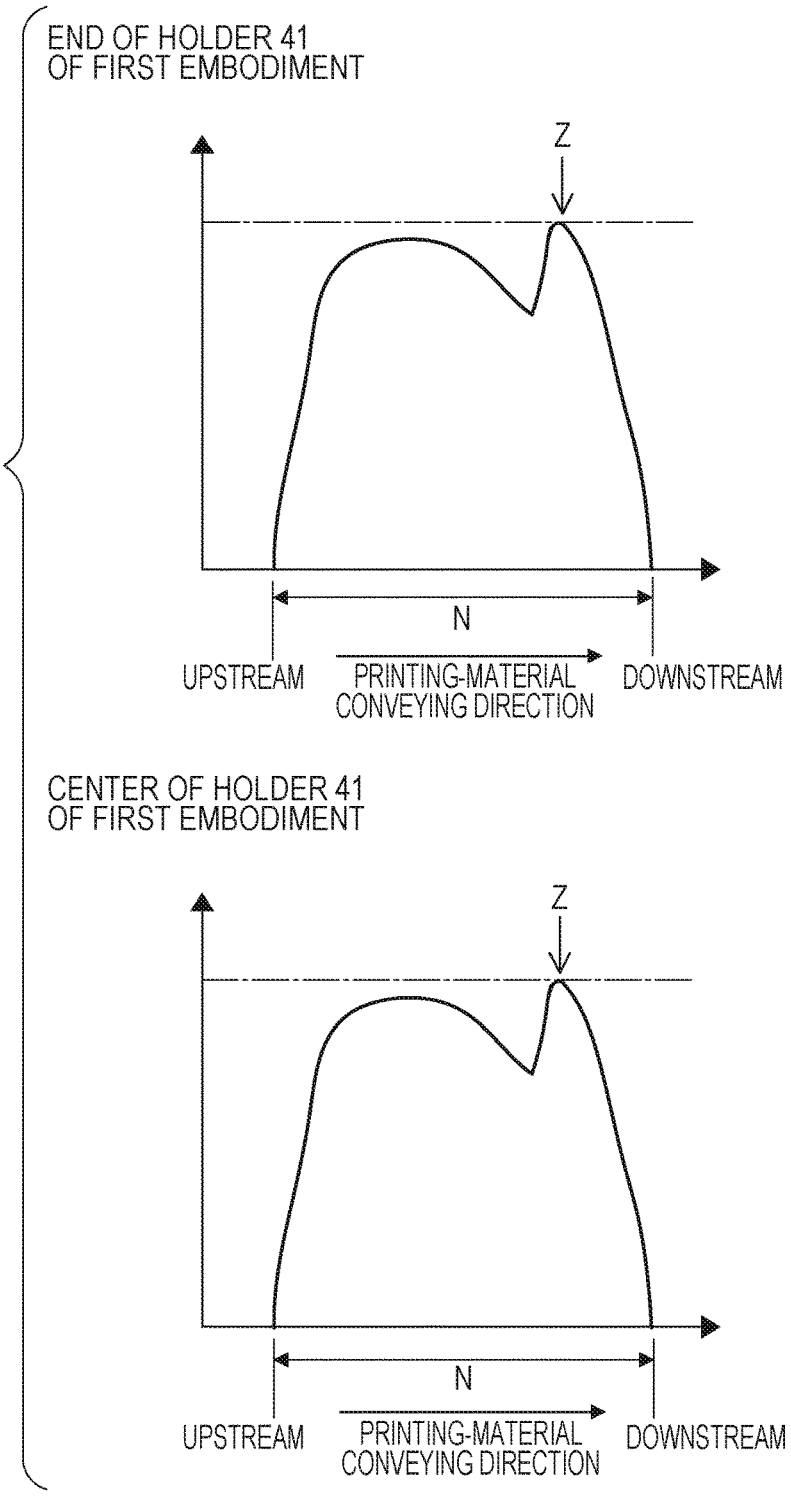
FIG. 9B is a diagram illustrating a pressing force peak due to the protruding portion of the holder of the first embodiment, according to one or more embodiments of the subject disclosure.

FIG. 9B illustrates a pressing force distribution at the nip portion N in the printing-material conveying direction at the ends of the holder 41 in the longitudinal direction and a pressing force distribution at the nip portion N in the printing-material conveying direction at the center of the holder 41 in the longitudinal direction in the case where the holder 41 of the present disclosure is used.

Since the holder 41 is hardly deflected, the protruding portion 41*b* is at substantially the same position in the nip portion N at the ends and the center of the holder 41. Therefore, the nip portion N has an ideal pressing force distribution in which a high pressing force peak Z is on the downstream side in the conveying direction because of the action of the protruding portion 41*b*.

Figure 10B:
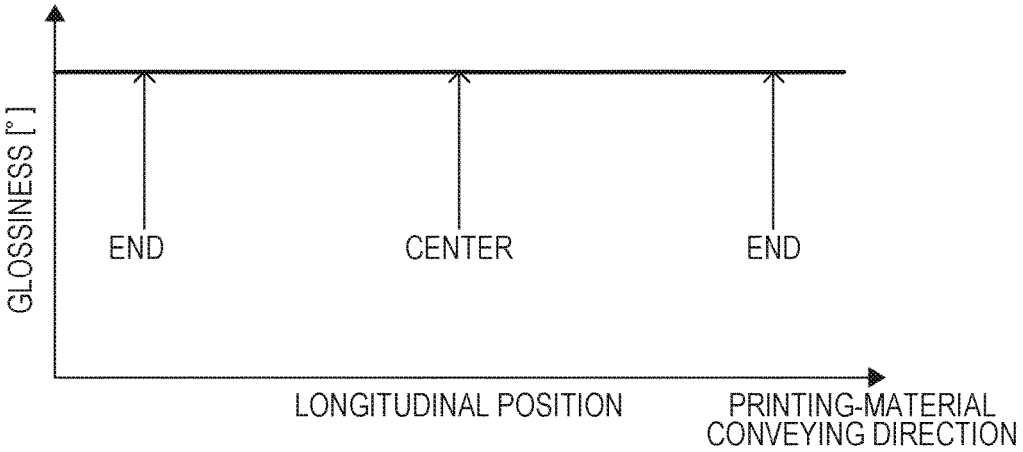
FIG. 10B is a diagram illustrating the distribution of the glossiness of a toner image when the holder of the first embodiment is used, according to one or more embodiments of the subject disclosure.

FIG. 10B illustrates the distribution of the glossiness of the toner image T in the longitudinal direction perpendicular to the printing-material conveying direction when the holder 41 of the present embodiment is used. A method for evaluating the glossiness is the same as that described in (3-1).

The ends and the center of the holder 41 have the same pressing force peak Z (see the diagrams on the right and left of FIG. 9B) downstream in the printing-material conveying direction of the nip portion N. This allows an image with less decline in glossiness at the center than the comparative example illustrated in FIG. 9A to be output.

The fixing apparatus 102 of the present embodiment is configured such that the contact surfaces J2, J3, L2, and L3 of the outer wall 501 and the regulating ribs 504 of the holder 41 come into contact with the surfaces Q2, Q3, R2, and R3 of the pressure stay 42 on the upstream side in the printing-material conveying direction so that the position of the holder 41 with respect to the pressure stay 42 is restricted.

In the longitudinal direction perpendicular to the printing-material conveying direction, the contact surfaces J3 and L3 at the center of the holder 41 are positioned downstream from the contact surfaces J2 and L2 at the ends in the printing-material conveying direction. This reduces or eliminates deflection of the center of the holder 41 in the longitudinal direction perpendicular to the printing-material conveying direction toward the downstream side in the printing-material conveying direction.

This allows the pressure peak (the maximum point of pressure) using the protruding portion 41*b* on the downstream side in the printing-material conveying direction across the entire nip portion N formed area to be uniform across the entire length perpendicular to the printing-material conveying direction. This enables a toner image T with uniform glossiness in the longitudinal direction perpendicular to the printing-material conveying direction to be formed.

In the present embodiment, the positioning of the holder 41 with respect to the pressure stay 42 is performed at two places on the upstream side and the downstream side in the printing-material conveying direction and at eight places A to H in the longitudinal direction perpendicular to the printing-material conveying direction, but this is given for mere illustration. The positioning may be performed at one place or three or more places in the printing-material conveying direction, or alternatively, at three places in the longitudinal direction perpendicular to the printing-material conveying direction according to the configuration and rigidity of the holder 41 and the pressure stay 42. In other words, at least one of the contact surfaces J2, J3, L2, L3 of the outer wall and the regulating ribs of the holder 41 may provided in the printing-material conveying direction.

In the present embodiment, the positions of the contact surfaces J2 J3, L2, and L3 of the holder 41 are changed by changing the thicknesses of the outer wall 501 and the regulating ribs 504. This is given for mere illustration and is not intended to limit the present disclosure. The positions of the contact surfaces J2, J3, L2, and L3 may be changed by changing the positions of the outer wall 501 and the regulating ribs 504 of the holder 41 without changing the thicknesses of the outer wall 501 and the regulating ribs 504 of the holder 41.

The deflection amount can also differ from that of the present embodiment depending on the material or structure of the holder 41. In such a case, the positions of the contact surfaces J2, J3, L2, and L3 of the holder 41 with respect to the pressure stay 42 may be adjusted for the ends and the center in the longitudinal direction perpendicular to the printing-material conveying direction according to the deflection amount of the holder 41.

Figure 11A:
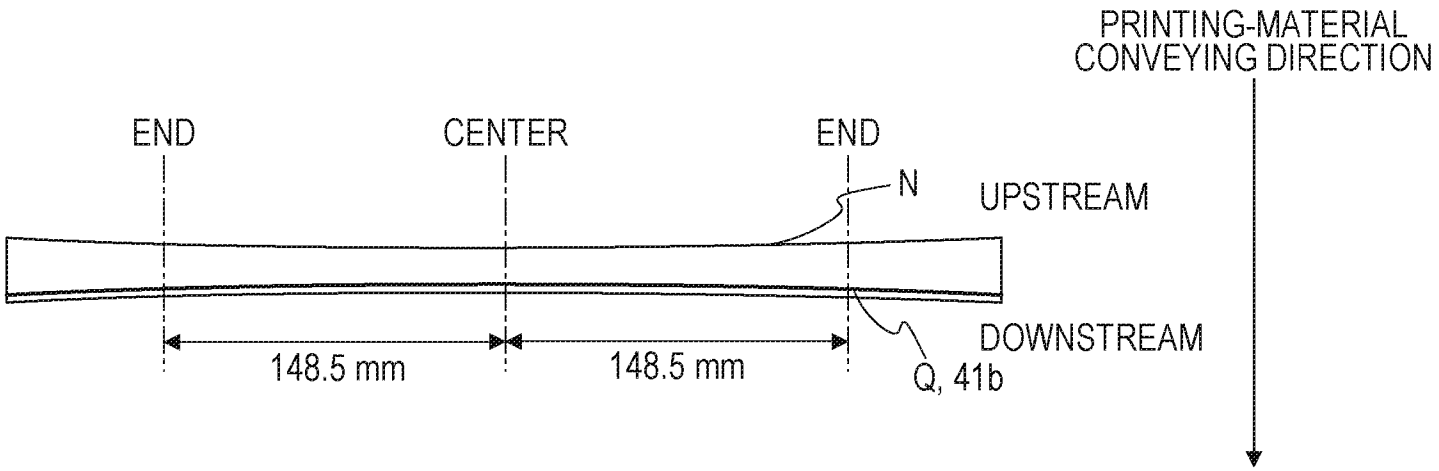
FIG. 11A is a diagram illustrating the shape of a nip portion in the case where the outer shape of the pressure roller has an inversed crown shape, according to one or more embodiments of the subject disclosure.

FIG. 11A is a diagram illustrating the shape of the nip portion N in the case where the outer shape of the pressure roller 20 has an inversed crown shape. The inversed crown shape is a shape in which the diameter of the pressure roller 20 increases with a decreasing distance from the center to the ends in the axial direction of the pressure roller 20.

As illustrated in FIG. 11A, the pressure roller 20 may be designed to have a shape narrower at the center of the nip portion N than at the ends in the longitudinal direction perpendicular to the printing-material conveying direction (a thin-center nip shape). With the nip portion N having such a shape, the force of conveying the printing material P is larger at the ends than the center in the longitudinal direction perpendicular to the printing-material conveying direction. This has the effect of stretching the printing material P from the center to the ends so that wrinkles are less likely to occur in the printing material P.

To obtain uniform glossiness across the entire length perpendicular to the printing-material conveying direction with the thin-center shape, the protruding portion 41*b* of the holder 41 may be disposed along the shape of the nip portion N on the downstream side in the printing-material conveying direction, as indicated by reference sign Q in FIG. 11A. In other words, as Table 3 shows, the difference in the positional relationship between the contact surfaces J2 and J3 of the outer wall 501 of the holder 41 and the contact surfaces L2 and L3 of the regulating ribs 504 is made larger than that in Table (2) which is for the purpose of correcting the deflection amount. Along with that, the interval between the outer wall 501 and the regulating ribs 503 and the interval between the outer wall 502 and the regulating ribs 504 may also be adjusted.

TABLE 3

| POSITION IN CONVEYING DIRECTION | ITEM | SIGN | LONGITUDINAL POSITION A | B | C | D | E | F | G | H |
|---|---|---|---|---|---|---|---|---|---|---|
| UPSTREAM | THICKNESS: OUTER WALL 501 | P1 | 2.0 | 2.3 | 2.5 | 2.8 | 2.8 | 2.5 | 2.3 | 2.0 |
| | INTERVAL: OUTER WALL 501- | P3 | 3.5 | 3.2 | 3.0 | 2.7 | 2.7 | 3.0 | 3.2 | 3.5 |

TABLE 3-continued

| POSITION IN CONVEYING DIRECTION | ITEM | SIGN | LONGITUDINAL POSITION A | B | C | D | E | F | G | H |
|---|---|---|---|---|---|---|---|---|---|---|
| | RESRICTPING RIB 503 THICKNESS: | P2 | 2.0 | 2.0 | 2.0 | 2.0 | 2.0 | 2.0 | 2.0 | 2.0 |
| | RESTRICTING RIB 503 | | | | | | | | | |
| DOWNSTREAM | THICKNESS: RESTRICTING RIB 504 | P4 | 2.0 | 2.3 | 2.5 | 2.8 | 2.8 | 2.5 | 2.3 | 2.0 |
| | INTERVAL: OUTER WALL 502-RESTRICTING RIB 504 | P6 | 3.5 | 3.2 | 3.0 | 2.7 | 2.7 | 3.0 | 3.2 | 3.5 |
| | THICKNESS: OUTER WALL 502 | P5 | 2.0 | 2.0 | 2.0 | 2.0 | 2.0 | 2.0 | 2.0 | 2.0 |

Figures 1, 11B:
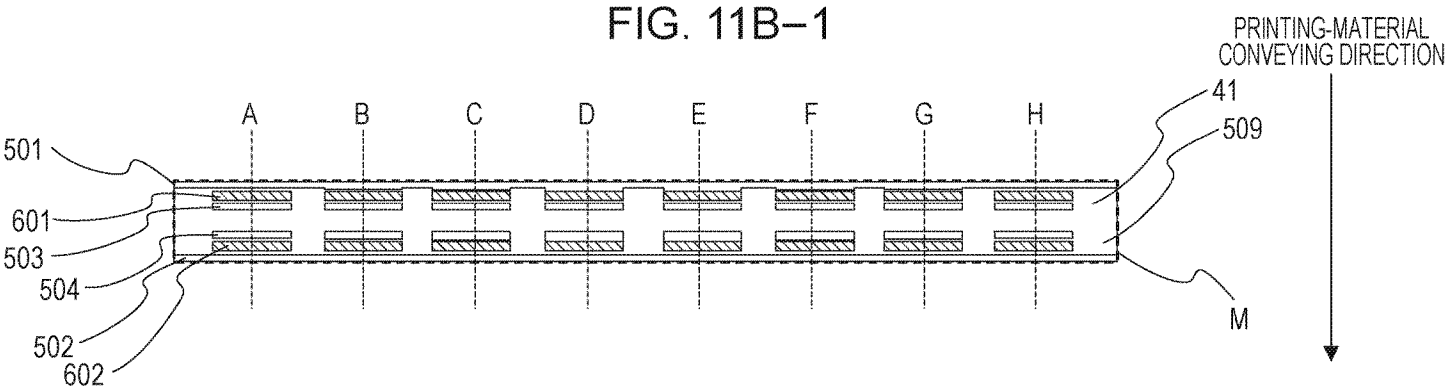
Figures 2, 11B:
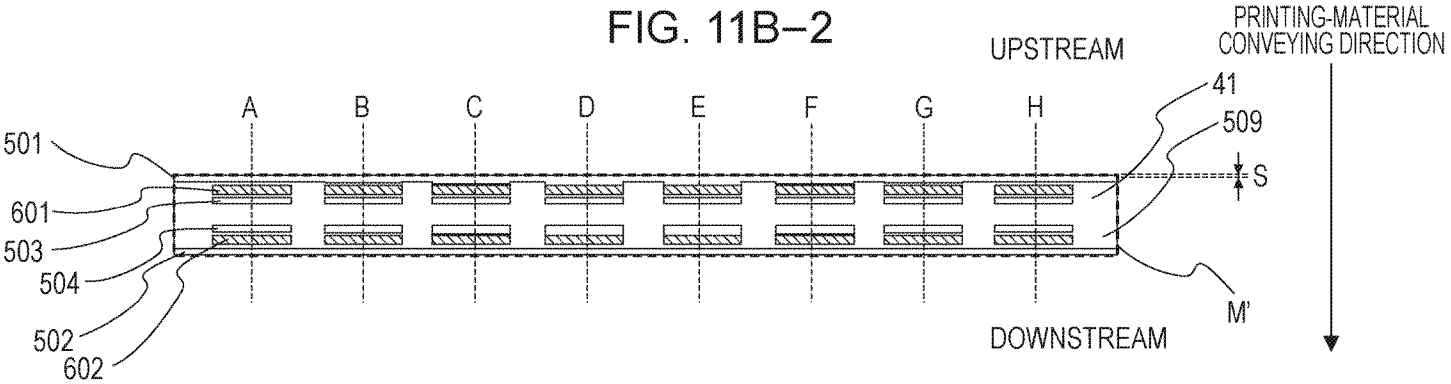

FIG. 11B-1 illustrates the positional relationship among the outer walls 501 and 502 and the regulating ribs 503 and 504 of the holder 41 shown in Table 3 and the ribs 601 and 602 of the pressure stay 42, and the shape M of the holder 41 with the film 10 at rest. FIG. 11B-2 illustrates the positional relationship among the outer walls 501 and 502 and the regulating ribs 503 and 504 of the holder 41 shown in Table 3 and the ribs 601 and 602 of the pressure stay 42, and the shape M' of the holder 41 while the film 10 is rotating.

The shape M' of the holder 41 illustrated in FIG. 11B-2 deflects toward the upstream side in the printing-material conveying direction from the shape M of the holder 41 illustrated in FIG. 11B-1 (deflection amount: S=–0.3 mm). By adjusting the positional relationship among the contact surfaces J2 and J3 of the outer wall 501 of the holder 41 and the contact surfaces L2 and L3 of the regulating rib 504 in this manner, the protruding portion 41*b* of the holder 41 can be aligned with the shape of the nip portion N on the downstream side in the printing-material conveying direction. This allows the pressure peak due to the protruding portion 41*b* to be uniform across the entire nip portion N in the longitudinal direction perpendicular to the printing-material conveying direction, providing a toner image T with uniform glossiness.

Second Embodiment

A fixing apparatus according to another embodiment will be described. In the present embodiment, only differences from the fixing apparatus 102 of the first embodiment will be described.

Figure 12A:
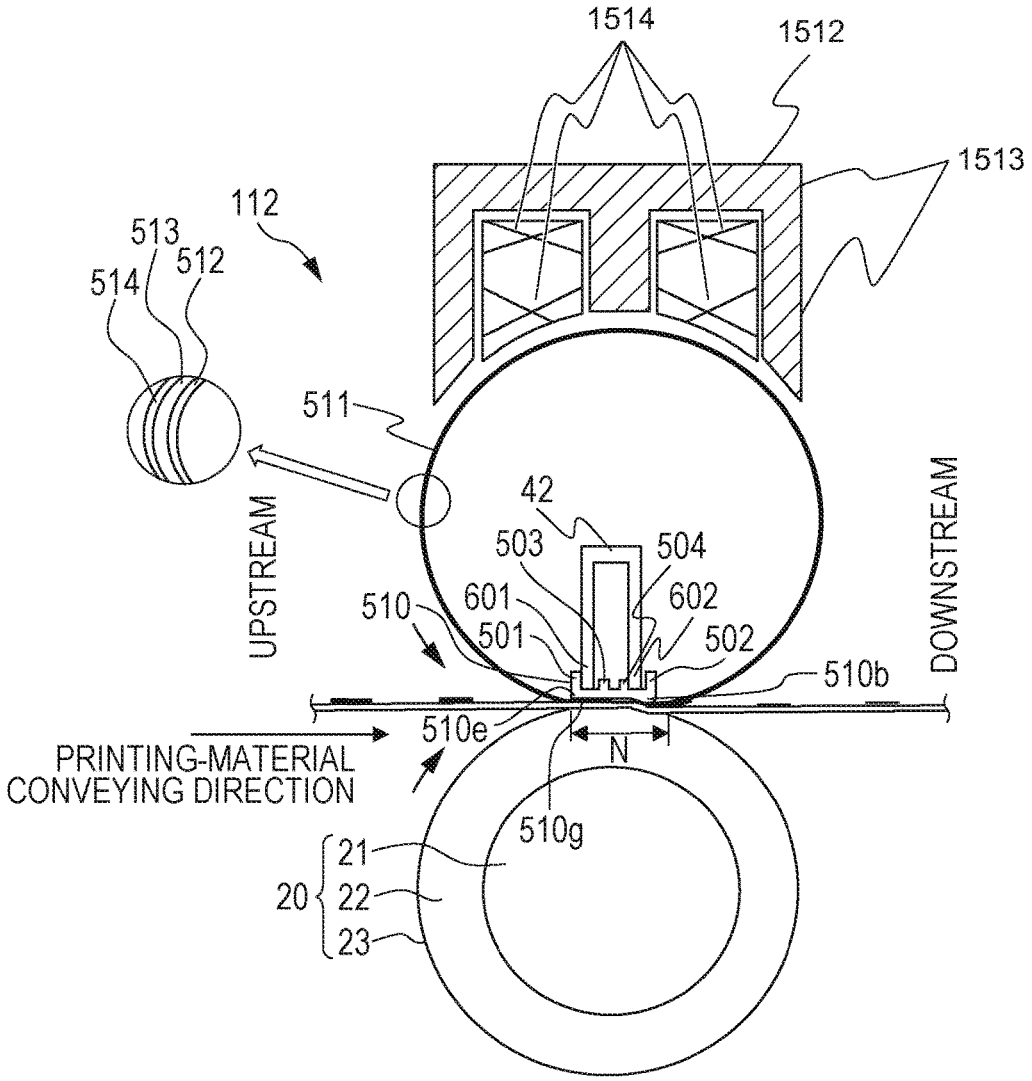
FIG. 12A is a cross-sectional view of a fixing apparatus according to a second embodiment illustrating, in outline, the configuration thereof, according to one or more embodiments of the subject disclosure.
Figure 12B:
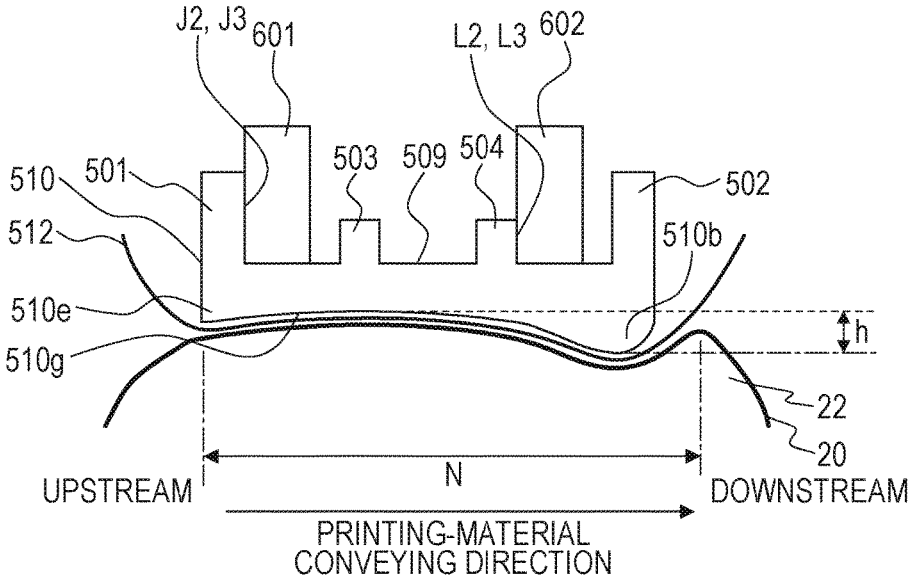
FIG. 12B is a diagram for illustrating the protruding amount of a protruding portion of a nip-portion forming member of the fixing apparatus of the second embodiment, according to one or more embodiments of the subject disclosure.
Figure 12C:
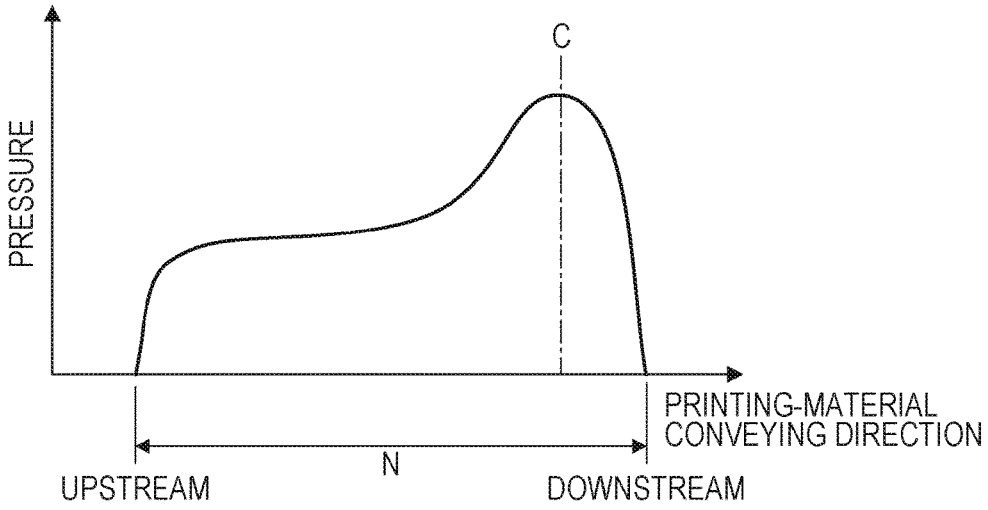
FIG. 12C is a diagram illustrating a pressure distribution in the printing-material conveying direction in the nip portion of the fixing apparatus of the second embodiment, according to one or more embodiments of the subject disclosure.

FIGS. 12A to 12C are diagrams for illustrating a fixing apparatus 112 according to the present embodiment. FIG. 12A is a cross-sectional view of the film heating type fixing apparatus 112 using electromagnetic induction illustrating, in outline, the configuration thereof. FIG. 12B is a diagram for illustrating a protruding amount h of a protruding portion 510*b* of a nip-portion forming member 510 of the fixing apparatus 112 of the present embodiment. FIG. 12C is a diagram illustrating a pressure distribution in the printing-material conveying direction in the nip portion N of the fixing apparatus 112 of the present embodiment.

In FIG. 12A, reference sign 511 denotes a rotatable cylindrical sleeve. The sleeve 511 includes a heat generating layer 512 that generates heat by the action of a magnetic field, an elastic layer 513 provided on the outer circumferential surface of the heat generating layer 512, and a releasing layer 514 provided on the outer circumferential surface of the elastic layer 513.

The nip-portion forming member 510 disposed through the hollow portion of the sleeve 511 and serving as a guide member is made of heat-resistant resin, such as liquid crystal polymer, phenol resin, PPS, or PEEK. The nip-portion forming member 510 has an arc-shaped guide surface 510*g* provided in the longitudinal direction perpendicular to the printing-material conveying direction and the protruding portion 510*b* at a portion of the nip-portion forming member 510 facing the pressure roller 20. The nip-portion forming member 510 is configured to guide the rotation of the sleeve 511 using the guide surface 510*g* provided upstream from the protruding portion 510*b* in the printing-material conveying direction. The shape of the protruding portion 510*b* will be described later.

The both ends of the nip-portion forming member 510 and the pressure stay 42 are supported by left and right flanges (not shown) held by the frame (not shown) of the fixing apparatus 112 in the longitudinal direction perpendicular to the printing-material conveying direction. The both ends of the pressure stay 42 are pressed in a direction perpendicular to the generatrix of the sleeve 511 by left and right pressure springs (not shown) serving as pressing units, so that the flanges push down the nip-portion forming member 510 in the same direction.

This causes the nip-portion forming member 510 to press an edge 510*e* of the nip-portion forming member 510 on the upstream side in the printing-material conveying direction, the guide surface 510*g* in the central area, and the protruding portion 510*b* on the downstream side against the inner circumferential surface (inner surface) of the sleeve 511. This causes the outer circumferential surface (surface) of the sleeve 511 to be brought into pressure-contact with the outer circumferential surface (surface) of the pressure roller 20 serving as a pressure rotating member, so that the elastic layer 22 of the pressure roller 20 is crushed and elastically deformed to form the nip portion N having a predetermined width between the surface of the sleeve 511 and the surface of the pressure roller 20.

A magnetic-field generating unit 1512 disposed on an outer circumferential surface of the sleeve 511 opposite to the pressure roller 20 includes a coil (exciting coil) 1514 serving as a heat source and a magnetic core (core material) 1513 for guiding magnetic flux generated from the coil 1514 to the sleeve 511.

The heating fixing processing operation of the fixing apparatus 112 will be described.

As illustrated in FIG. 12A, the metal core 21 of the pressure roller 20 rotatably supported by the frame rotates in the direction of the arrow. This causes the sleeve 511 to rotate in the direction of the arrow so as to follow the rotation of the pressure roller 20, with the inner surface of the sleeve 511 in contact with the guide surface 510*g* and the protruding portion 510*b* of the nip-portion forming member 510.

When an alternating current is supplied from an exciting current (not shown) to the coil 1514 of the magnetic-field generating unit 1512, the heat generating layer 512 generates heat due to magnetic flux generated from the coil 1514 to rapidly increase the temperature of the sleeve 511. A temperature control unit (not shown) acquires a temperature inside the sleeve 511 detected by a thermistor (not shown) serving as a temperature detecting member and controls the amount of alternating current to be supplied to the coil 1514 so that the detected temperature is kept at a predetermined fixing temperature (target temperature).

The printing material P carrying the unfixed toner image T is heated while being nipped and conveyed through the nip portion N, so that the toner image T is fixed onto the printing material P.

As illustrated in FIG. 12B, the protruding portion 510*b* of the nip-portion forming member 510 is positioned on the downstream side in the printing-material conveying direction of the nip portion N. The protruding portion 510*b* protrudes toward the pressure roller 20 by the protruding amount h from the sliding surface of the nip-portion forming member 510 with respect to the inner surface of the sleeve 511. The protruding amount h is defined as the distance from the lowest bottom of the guide surface 510*g* that slides on the inner surface of the sleeve 511 at a position lower than the protruding portion 510*b* of the nip-portion forming member 510 to the end of the protruding portion 510*b*.

Since the nip-portion forming member 510 is not a plate-like heater as in the first embodiment, the nip-portion forming member 510 can be freely shaped. Therefore, the guide surface 510*g* of the nip-portion forming member 510 which comes into contact with the inner surface of the sleeve 511 can be curved with a curvature gradually increasing toward the protruding portion 510*b* . This allows the nip portion N to have a distribution in the printing-material conveying direction such that the pressure peak C gradually increases toward the downstream side in the printing-material conveying direction as in FIG. 12C, not the pressure distribution having two pressing force peaks described in the first embodiment.

When the sleeve 511 rotates along with the rotation of the pressure roller 20, the nip-portion forming member 510 is deflected more at the center than at the ends in the longitudinal direction perpendicular to the printing-material conveying direction, like the holder 41 of the first embodiment. Accordingly, as in the first embodiment, the positional relationship among the contact surfaces J2 and J3 of the outer wall 501 of the nip-portion forming member 510 and the contact surfaces L2 and L3 of the regulating ribs 504 may be adjusted according to the deflection amount of the nip-portion forming member 510.

The peak position of pressure applied by the protruding portion 510*b* of the nip-portion forming member 510 is adjusted in this way. This allows the pressure peak due to the protruding portion 510*b* to be uniform across the entire nip portion N in the longitudinal direction perpendicular to the printing-material conveying direction, providing a toner image T with uniform glossiness.

Third Embodiment

A fixing apparatus according to still another embodiment will be described. In the present embodiment, only differences from the fixing apparatus 102 of the first embodiment will be described.

Figure 13A:
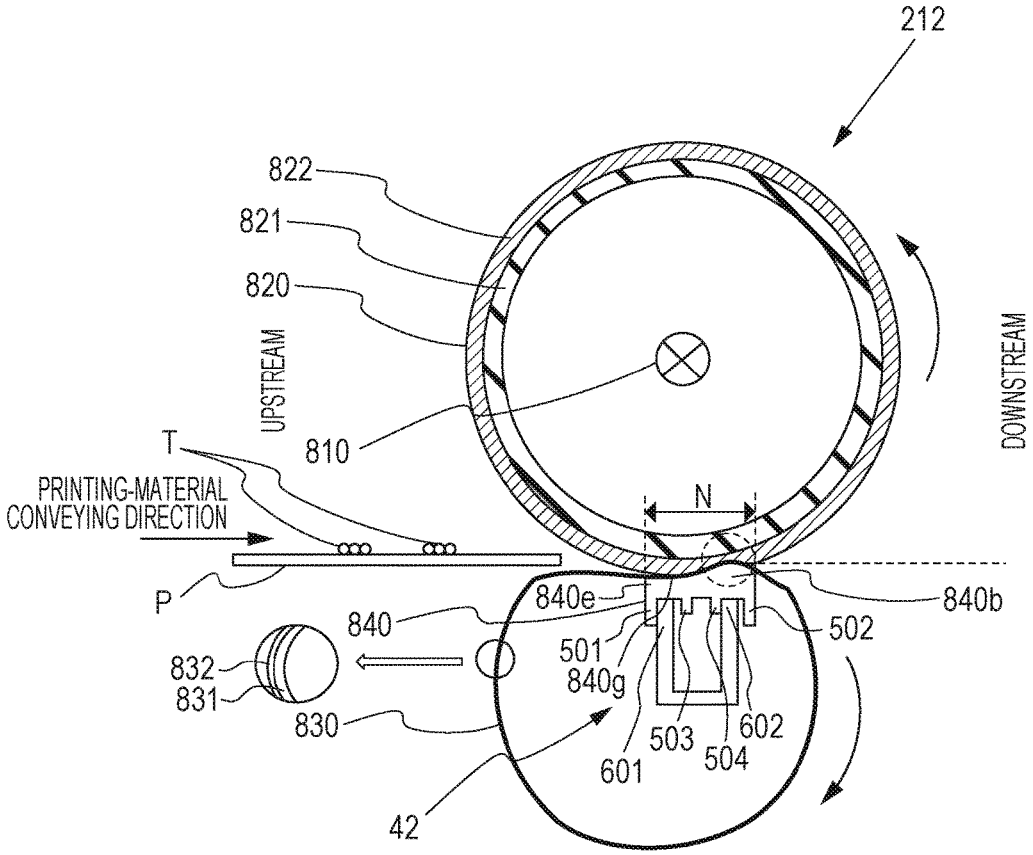
FIG. 13A is a cross-sectional view of a fixing apparatus according to a third embodiment illustrating, in outline, the configuration thereof, according to one or more embodiments of the subject disclosure.
Figure 13B:
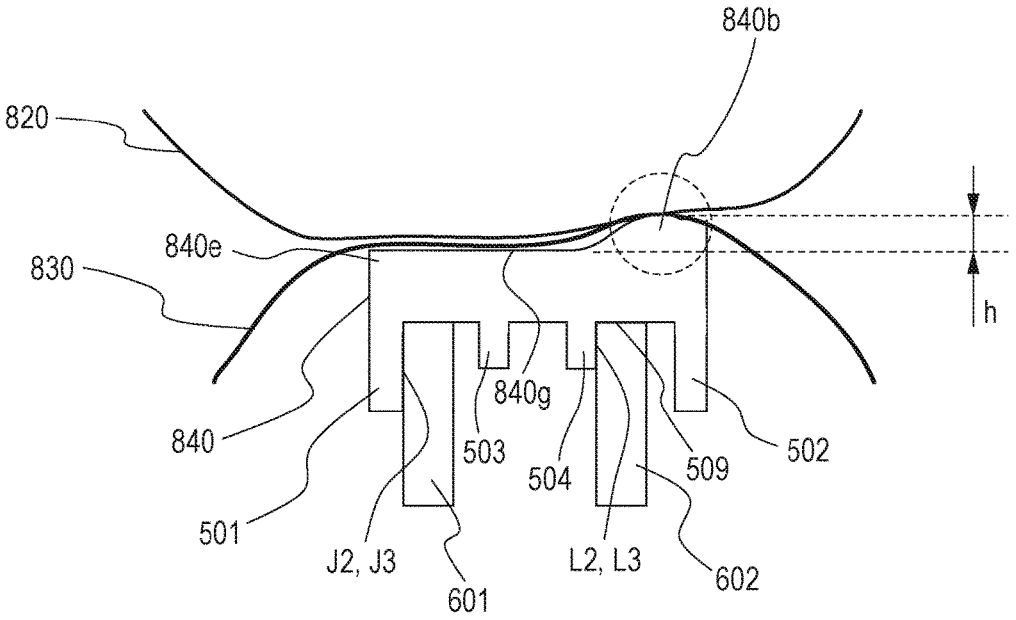
FIG. 13B is a diagram for illustrating the protruding amount of a protruding portion of a nip-portion forming member of the fixing apparatus of the third embodiment, according to one or more embodiments of the subject disclosure.

FIGS. 13A and 13B are diagrams for illustrating a fixing apparatus 212 according to the present embodiment. FIG. 13A is a cross-sectional view of the radiant heating type fixing apparatus 212 using a halogen heater 810 illustrating, in outline, the configuration thereof. FIG. 13B is a diagram for illustrating a protruding amount h of a protruding portion 840*b* of a nip-portion forming member 840 of the fixing apparatus 212 of the present embodiment.

In FIG. 13A, reference sign 820 denotes a cylindrical roller (hereinafter referred to as "fixing roller"), or a tubular pressing rotating member. The fixing roller 820 includes a base layer 821 which is a cylindrical iron core, and an elastic layer 822 which is a heat-resistant silicone rubber layer disposed on the outer circumferential surface of the base layer 821. The fixing roller 820 further includes a releasing layer (not shown) which is a fluororesin layer, disposed on the outer circumferential surface of the elastic layer 822. The base layer 821 has a thickness of 2.5 mm, the elastic layer 822 has a thickness of 2.5 mm, and the releasing layer has a thickness of 50 μm. The fixing roller 820 has a diameter of 30 mm.

Reference sign 830 denotes a cylindrical rotatable film. The film 830 includes an endless film-like base layer 831 made of a heat-resistant flexible material and a releasing layer 832 disposed on the outer circumferential surface of the base layer 831. The base layer 831 is made with polyimide resin having a thickness of 50 μm. The releasing layer 832 is a fluororesin layer having a thickness of 20 μm.

The nip-portion forming member 840 serving as a support member disposed through the hollow portion of the film 830 is formed of heat resistant resin, such as liquid crystal polymer, phenol resin, PPS, or PEEK. The nip-portion forming member 840 includes a guide surface 840*g* and the protruding portion 840*b* extending in the longitudinal direction perpendicular to the printing-material conveying direction, which are opposed to the fixing roller 820. The nip-portion forming member 840 supports the rotation of the film 830 using the guide surface 840*g* provided upstream from the protruding portion 840*b* in the printing-material conveying direction. The shape of the protruding portion 840*b* will be described later.

The both ends of the nip-portion forming member 840 and the pressure stay 42 are supported by the left and right flanges 45L and 45R held by the frame (not shown) of the fixing apparatus 212 in the longitudinal direction perpendicular to the printing-material conveying direction. The both ends of the pressure stay 42 are pressed in a direction perpendicular to the generatrix of the film 830 by left and right pressure springs serving as pressing units, so that the flanges push down nip-portion forming member 840 in the same direction.

This causes the nip-portion forming member 840 to press an edge 840*e* of the nip-portion forming member 840 on the upstream side in the printing-material conveying direction, the guide surface 840*g* in the central area, and the protruding portion 840*b* on the downstream side against the inner circumferential surface (inner surface) of the film 830. This causes the outer circumferential surface (surface) of the film 830 to be brought into pressure-contact with the outer circumferential surface (surface) of the fixing roller 820, so that the elastic layer 822 of the fixing roller 820 is crushed and elastically deformed to form the nip portion N having a predetermined width between the surface of the film 830 and the surface of the fixing roller 820.

In the hollow portion of the fixing roller 820, the halogen heater (heater) 810 serving as a heat source is disposed.

The heating fixing processing operation of the fixing apparatus 212 will be described.

As illustrated in FIG. 13A, the base layer 821 of the fixing roller 820 rotatably supported by the frame rotates in the direction of the arrow. This causes the film 830 to rotate in the direction of the arrow so as to follow the rotation of the pressure roller 20, with the inner surface of the film 830 in contact with the guide surface 840*g* and the protruding portion 840*b* of the nip-portion forming member 840.

When electrical power is supplied from an alternating-current source (not shown) to the halogen heater 810 rotatably supported by the frame, the base layer 821 is heated by radiant heat radiated from the halogen heater 810 to rapidly increase the temperature of the fixing roller 820. A temperature control unit (not shown) acquires a temperature inside the film 830 detected by a thermistor (not shown) serving as a temperature detecting member and controls the amount of electrical power to be supplied to the halogen heater 810 so that the detected temperature is kept at a predetermined fixing temperature (target temperature).

The printing material P carrying the unfixed toner image T is heated while being nipped and conveyed through the nip portion N, so that the toner image T is fixed onto the printing material P.

As illustrated in FIG. 13B, the protruding portion 840*b* of the nip-portion forming member 840 is positioned on the downstream side in the printing-material conveying direction of the nip portion N. The protruding portion 840*b* protrudes toward the fixing roller 820 by the protruding amount h from the sliding surface of the nip-portion forming member 840 with respect to the inner surface of the film 830. The protruding amount h is defined as the distance from the guide surface 840*g* that slides on the inner surface of the film 830 at a position lower than the protruding portion 840*b* of the nip-portion forming member 840 to the end of the protruding portion 840*b*.

As in the second embodiment, the guide surface 840*g* of the nip-portion forming member 840 which comes into contact with the inner surface of the film 830 can be curved with a curvature gradually increasing toward the protruding portion 840*b*. This allows the nip portion N to have a pressure distribution in the printing-material conveying direction such that the pressure peak C gradually increases toward the downstream side in the printing-material conveying direction as in FIG. 12C, not the pressure distribution having two pressing force peaks described in the first embodiment.

When the film 830 rotates along with the rotation of the fixing roller 820, the nip-portion forming member 840 is deflected more at the center than at the ends in the longitudinal direction perpendicular to the printing-material conveying direction, like the holder 41 of the first embodiment. Accordingly, as in the first embodiment, the positional relationship among the contact surfaces J2 and J3 of the outer wall 501 of the nip-portion forming member 840 and the contact surfaces L2 and L3 of the regulating ribs 504 may be adjusted according to the deflection amount of the nip-portion forming member 840.

The peak position of pressure applied by the protruding portion 840*b* of the nip-portion forming member 840 is adjusted in this way. This allows the pressure peak due to the protruding portion 840*b* to be uniform across the entire nip portion N in the longitudinal direction perpendicular to the printing-material conveying direction, providing a toner image T with uniform glossiness.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-002376 filed Jan. 11, 2017 and No. 2017-220726 filed Nov. 16, 2017, which are hereby incorporated by reference herein in their entirety.

What is claimed is:

1. A fixing apparatus comprising:

a cylindrical rotating member;

a guide member in contact with an inner surface of the rotating member and configured to guide rotation of the rotating member;

a roller forming a nip portion together with the guide member, with the rotating member in between;

a stay disposed in a hollow portion of the rotating member and configured to reinforce the guide member, wherein an image carried by a printing material is fixed onto the printing material while the printing material is nipped and conveyed through the nip portion, and wherein the guide member has a contact surface that restricts a position of the guide member with respect to the stay by coming into contact with a surface of the stay on the upstream side in the printing-material conveying direction, the contact surface being disposed, in a direction perpendicular to the printing-material conveying direction, in such a manner that a center is downstream from ends in the printing-material conveying direction.

2. The fixing apparatus according to claim 1, further comprising:

a restricting member configured to restrict movement of the rotating member in the direction perpendicular to the printing-material conveying direction, wherein both ends of the stay and the guide member are supported by the restricting member.

3. The fixing apparatus according to claim 1, wherein the guide member comprises a protruding portion protruding toward the roller, the protruding portion being positioned on the downstream side in the printing-material conveying direction of the nip portion.

4. The fixing apparatus according to claim 1, wherein the rotating member comprises a film, and wherein the apparatus further comprises a heater configured to heat the film, the heater being supported by the guide member and in contact with an inner circumferential surface of the film.

5. The fixing apparatus according to claim 1, wherein the rotating member comprises an electrically conductive layer, and wherein the apparatus further comprises a coil that generates a magnetic flux for causing the electrically conductive layer to generate heat by electromagnetic induction.

* * * * *